US007802580B2

(12) United States Patent
Hermanson et al.

(10) Patent No.: US 7,802,580 B2
(45) Date of Patent: Sep. 28, 2010

(54) UMBRELLA

(75) Inventors: Terry Hermanson, New York, NY (US); George Raustiala, New York, NY (US)

(73) Assignee: Mr. Christmas, Inc., New York, NY (US)

( * ) Notice: Subject to any disclaimer, the term of this patent is extended or adjusted under 35 U.S.C. 154(b) by 65 days.

(21) Appl. No.: 11/650,926

(22) Filed: Jan. 9, 2007

(65) Prior Publication Data

US 2008/0163912 A1 Jul. 10, 2008

(51) Int. Cl.
*A45B 25/00* (2006.01)
*A45B 25/18* (2006.01)
*A45B 15/00* (2006.01)

(52) U.S. Cl. ..... 135/29; 135/33.2; 135/33.41; 135/25.4

(58) Field of Classification Search ..... 135/15.1, 135/20.3, 22, 23, 25.1, 31, 32, 33.2, 33.4, 135/33.41, 98, 99, 151, 156, 907; 211/197
See application file for complete search history.

(56) References Cited

U.S. PATENT DOCUMENTS

| | | | | | |
|---|---|---|---|---|---|
| 356,479 | A | * | 1/1887 | Kremer | 135/22 |
| 579,185 | A | * | 3/1897 | Shaine | 135/25.1 |
| 635,811 | A | * | 10/1899 | Rothschild | 135/33.41 |
| 2,483,585 | A | * | 10/1949 | Lewis | 211/197 |
| 2,690,187 | A | * | 9/1954 | Thompson | 135/15.1 |
| 3,386,455 | A | * | 6/1968 | O'Rear | 135/15.1 |
| 3,705,593 | A | * | 12/1972 | Weber | 135/26 |
| 3,892,251 | A | * | 7/1975 | Warfield | 135/15.1 |
| 4,038,997 | A | * | 8/1977 | Smith | 135/114 |
| 4,101,037 | A | * | 7/1978 | Allesch et al. | 211/167 |
| 4,813,442 | A | * | 3/1989 | Haines | 135/98 |
| 4,979,535 | A | * | 12/1990 | Sadowski et al. | 135/33.41 |
| 5,226,438 | A | * | 7/1993 | Dubinsky | 135/33.4 |
| 5,482,069 | A | | 1/1996 | Lee | 135/31 |
| 5,826,604 | A | * | 10/1998 | Hartmann | 135/27 |
| 5,836,328 | A | | 11/1998 | Lee | 135/25.2 |
| 6,318,391 | B1 | | 11/2001 | You | 135/33.7 |
| 6,698,440 | B2 | | 3/2004 | Beyer et al. | 135/25.41 |
| 2005/0236024 | A1 | | 10/2005 | Wu | 135/27 |
| 2006/0254636 | A1 | * | 11/2006 | Tung | 135/96 |

* cited by examiner

*Primary Examiner*—David Dunn
*Assistant Examiner*—Danielle Jackson
(74) *Attorney, Agent, or Firm*—Fitzpatrick, Cella, Harper & Scinto

(57) ABSTRACT

An umbrella includes a staff assembly, a plurality of upper ribs, a plurality of corresponding lower ribs and a canopy. The staff assembly includes an inner staff member and an outer staff member slidably mounted thereon. The upper ribs are pivotally connected to the inner staff member. The lower ribs are pivotally connected to the outer staff member and to the upper ribs. The canopy is mounted on the upper or lower ribs. Sliding the inner and outer staff members with respect to each other in a longitudinal direction thereof shifts the ribs and the canopy between a deployed position in which the ribs and canopy extend generally radially outwardly from the staff assembly so as to open the umbrella, and a retracted position in which the ribs and the canopy are collapsed inwardly toward, the staff assembly so as to close the umbrella.

16 Claims, 18 Drawing Sheets

UMBRELLA

BACKGROUND OF THE INVENTION

1. Field of the Invention

This invention generally relates to umbrellas and, more particularly, to novel and improved constructions for umbrellas.

2. Description of the Related Art

While the umbrella has well-known utility, the current state of the art is imperfect and would benefit from improvements in a number of respects. It may be noted that different types of umbrellas suffer to some extent from different problems. Thus, it will be convenient at the outset to distinguish two basic kinds of umbrellas.

The terms "personal" or "portable," as used herein, refer to umbrellas that are designed to shelter a single individual and to be carried about by an individual. Accordingly, such umbrellas are optimally lightweight, compact when closed, and convenient (easy and quick) to open and close. These umbrellas are generally available in a range of sizes (e.g., oversized, full size, compact or travel size, and mini). In contrast to personal or portable umbrellas, the term "large-scale" or "stationary" will be used herein to refer to umbrellas designed to shelter more than one individual and to be fixed in place when in use (i.e., to provide protection from the sun, rain, etc.), although they may be portable when not in use. (In contrast, personal umbrellas are designed to be able to be used both while the user is in place and while the user is moving.) The intended use of large-scale umbrellas requires them to be much larger, heavier and stronger than personal umbrellas. Consequently, as a rule they are less convenient—i.e., they require more effort and time to open and close—than personal umbrellas. Common examples of large-scale umbrellas are beach umbrellas and table umbrellas, the latter being generally affixed at the center of a table, such as an outdoor café table or a home picnic table, for sheltering those seated at the table. While personal umbrellas are generally used to protect against the rain, large-scale umbrellas are commonly used to protect against the sun. The present invention is intended to be applicable to all kinds of umbrellas, including personal umbrellas, large-scale umbrellas and any other kind of umbrella.

One of the basic problems from which the umbrella suffers, in particular the personal umbrella, is durability. Durability of the umbrella may be conceived of as encompassing both short-term and long-term aspects. Here, short-term durability is meant to refer to durability during any given use, while long-term durability is meant to refer to durability over time or repeated use. As for short-term durability, since the personal umbrella is often used in the rain and the rain is often accompanied by wind, it is important for such an umbrella to be strong enough not to be turned inside out by powerful gusts of wind. As for long-term durability, it is desired that an umbrella remain functional for a long period of time, despite the wear and tear on the structure and the mechanism, due to repeated stress during use (e.g., from the wind) and to repeated opening and closing. Inasmuch as existing umbrellas suffer from limited durability, both short-term and long-term, there is a need for a more durable umbrella.

Second, while an umbrella should be easy to operate, i.e. to open and close, conventional umbrellas are often troublesome in this regard. Only minimal time, effort and strength should be required to open and close an umbrella. This is a matter not only of convenience and ease of use but, at least in the case of personal umbrellas, also of the basic sheltering functionality of the umbrella. Simply stated, it is often necessary to open an umbrella quickly to avoid getting wet. For example, it is frequently infeasible to open an umbrella prior to exiting a sheltered location (e.g., a vehicle or a vestibule); the user must wait until he or she is actually out of doors in the rain to open the umbrella. Moreover, the user must often exit the sheltered location and go into the rain quickly (e.g., when alighting a bus). In such situations, opening an umbrella with dispatch may be necessary to avoid getting wet. Conversely, etiquette may require one to close his or her umbrella promptly upon entering a sheltered location from the rain. Failure to do so may cause injury or inconvenience (e.g., getting wet) to other individuals and/or damage to vulnerable objects (e.g., carpets, furniture) and, in any event, is likely to be deemed impolite. Thus, the ability to close an umbrella easily and promptly is also socially and practically advantageous. However, many umbrellas are not capable of being opened and closed with sufficient ease and speed.

One attempted solution to this problem in the prior art has been the provision of an automatic opening and/or closing means, e.g., operated by a push button. Such a mechanism is often seen on personal umbrellas, but is not generally provided on large-scale (e.g., beach or café table) umbrellas. While such a mechanism may reduce the effort required of the user, the mechanism may not open or close the umbrella with the speed required for the above-described situations. In addition, such automatic mechanisms may be prone to malfunction or breakage, especially with repeated use. Repair services are unlikely to be available for such problems, and even if they were available, the relative costs of repair and purchase of a new umbrella would tend to rule out repair as a reasonable option. Thus, an otherwise functional umbrella may be rendered unusable on account of a failed automatic opening/closing mechanism. Finally, of course, such automatic mechanisms increase the complexity and cost of manufacture of the umbrella and hence the price for the consumer. Accordingly, there is a need for an umbrella that can be manually opened and closed with sufficient ease and speed as to render an automatic mechanism unnecessary.

It is noted that the matter of opening and closing large-scale umbrellas presents some issues different from those pertaining to personal umbrellas. Large-scale umbrellas, which are much larger and heavier than personal umbrellas in view of their function of protecting more than a single individual, are generally considerably more difficult and time-consuming to open and close than personal umbrellas. As there is generally a less pressing need to open and close these umbrellas with speed, the difficulty of operation is likely to loom larger as an inconvenience than the length of time required to open and close these umbrellas. Because of the sheer bulk of such umbrellas, mechanisms for automatically opening and closing them have generally not been provided, presumably because they would have to be so complex and powerful as to be prohibitive in terms of cost. However, in view of the difficulty of operation, manual assist mechanisms are commonly provided for table umbrellas although less frequently for beach umbrellas. A typical such manual assist mechanism is a pulley mechanism whereby the user rotates a crank handle to open and close the umbrella. In view of the size and weight of large-scale umbrellas, it will be appreciated that even with a manual assist mechanism, manual operation thereof will still be much more difficult and time-consuming than is the case for a personal umbrella. Thus, even though time may not be of the essence, a reduction in the amount of time required to operate the umbrella would still be beneficial.

Of course, manual assist mechanisms, like the automatic mechanisms described above, subject the umbrella to additional risk of malfunction and breakage. In addition, they increase the complexity and cost of manufacture, and hence the price for the consumer.

In the case of a stationary umbrella lacking a manual assist mechanism, e.g., a beach umbrella, it can be particularly difficult to open and close the umbrella on account of its height, as will be explained with reference to FIGS. 1A-1D and 2. As shown in those figures, a conventional umbrella includes a staff 3, a ring 4 slidingly mounted thereon, upper ribs 5, lower ribs 6 and a canopy 7, appropriately interconnected. (The terms "up," "down," "top," "bottom," "horizontal," "vertical," and the like are used throughout this application, in discussion of both the prior art and the present invention, with reference to the orientation of an umbrella in normal use, i.e., the umbrella being in its opened state and being used to protect a user from rain, sun, etc. Thus, in normal use, the staff would be disposed in a (substantially) upright or vertical position and the canopy would be located at or near the top of the umbrella. To open the conventional umbrella, ring 4 is pushed upward from a position near the bottom of the umbrella (as shown in dashed outline in FIG. 1B) to a position near the top of the umbrella (as shown in FIG. 1B); to close the umbrella, ring 4 is pulled downward from the position near the top of the umbrella (as shown in dashed outline in FIG. 1D) to the position near the bottom of the umbrella (as shown in FIG. 1D). Thus, in order to open or close the umbrella, it is necessary to reach up toward the top of the umbrella, either to raise ring 4 toward the top or to grasp ring 4 from the top to lower it toward the bottom. Because of the height of an umbrella such as a beach umbrella, however, it can be difficult to reach as high as is required (see FIG. 2). While this difficulty may exist even in a large personal umbrella, it can be particularly acute in the case of a large-scale umbrella lacking a manual assist mechanism. Accordingly, there is a need for a more convenient mechanism of opening and closing such umbrellas. (A fuller description of the structure and operation of the prior art umbrella, as contrasted with the umbrella of the present invention, is provided below in the "Detailed Description of the Preferred Embodiments.")

Beyond durability and convenience (ease, speed) of operation, a third challenge for conventional umbrellas is providing ample headroom. This problem pertains particularly to personal umbrellas. As shown, e.g., in FIGS. 1A and 1B, in the conventional personal umbrella canopy 7 is attached to upper ribs 5 on the upper side thereof, and lower ribs 6 are provided to support upper ribs 7 from below. The provision of lower ribs 6 below canopy 7, however, reduces the amount of headroom available to the user (see FIG. 3). In this regard, it may be noted that increasing the height of the umbrella by increasing the length of the staff 3 is not a desirable solution to the problem of inadequate headroom. First, increasing the length of the staff is likely to bring about the problem described above, namely, to make the umbrella difficult to operate because of the great reach required to raise and lower the ring 4 to open and close the umbrella. Second, the user may often want to bring the canopy close to his or her head in order to increase the scope of coverage provided to the user. Increasing the length of the staff would run counter to the user's purpose in this respect, by raising the canopy further away from the head and making it harder or impossible for the user to bring the canopy as close to the head as desired. Accordingly, there is a need for an alternative design of an umbrella that affords increased headroom.

As it is desired to maximize headroom, or the usable space or volume under the umbrella, when in use, so, conversely, it is desired to minimize the space taken up by the umbrella when not in use. That is, the umbrella should be as compact as possible for portability and storage. This presents a fourth problem for conventional umbrellas, again particularly for personal umbrellas. While the prior art has aimed to solve this problem by simply making personal umbrellas in smaller sizes, such overall size reductions also adversely affect the sheltering functionality of the umbrella. That is, in use, a reduced-size umbrella provides a smaller scope of coverage. Accordingly, it would be advantageous to provide a design that makes an umbrella more compact when closed but does not reduce the size of the umbrella when opened.

Since, as discussed, umbrellas suffer from a lack of durability, and indeed this problem may not be able to be solved completely, it would be desirable if it were easy to repair an umbrella, e.g., to replace broken or worn-out parts. The conventional umbrella is often designed poorly in this regard, and accordingly this constitutes a fifth problem for the conventional umbrella. For example, the canopy is often sewn to the upper ribs, precluding easy replacement thereof. In addition, the ribs are often connected to the staff and ring and to each other in a permanent manner, rendering it infeasible to replace one rib at a time. In short, prior art umbrellas are frequently designed so as not be able to be repaired. Consequently, even if only a small part of the umbrella is broken or not functioning, the entire umbrella must be discarded and a new umbrella purchased. Thus, consumers find themselves purchasing new umbrellas at too frequent intervals. Accordingly, there is a need for an umbrella that can be easily repaired, e.g., whose individual parts can be easily replaced.

Sixth, it would be advantageous to simplify the manufacture and reduce the cost of production of umbrellas. As discussed above, some of the attempted solutions to problems in the prior art, e.g., automatic and manual assist operating mechanisms, have complicated manufacture and increased the cost thereof. There is a need, therefore, for alternative solutions to problems in the art, which solve the problems by simplifying rather than complicating the umbrella design. An example of a simpler design would be a design which solves a problem without increasing the number of components of the umbrella (or which achieves the level of functionality of the current state of the art while reducing the number of components). An umbrella that both solves a problem and reduces the number of components would be highly advantageous. Such simpler designs would serve not only to simplify and reduce the cost of manufacture, but also to improve durability and facilitate repair, since fewer components means fewer potential sources of malfunction and breakage.

In addition to serving their basic sheltering function, umbrellas also serve aesthetic and other (e.g., commercial) purposes. Thus, the individual consumer often chooses an umbrella based on the same kind of considerations involved in selecting a piece of apparel, and the umbrella may even be intended to make a fashion statement. Umbrellas designed for use by corporate or other institutional entities, e.g., an outdoor café or a beach umbrella rental outlet, are selected not only with such aesthetic considerations in mind. The café, for example, may be concerned that its outdoor table umbrellas include images, text, logos or the like that establish or maintain its institutional or corporate identity, establish or maintain its intellectual property rights in trademark, or serve as a marketing tool to attract customers who might otherwise overlook or pass by the establishment.

Accordingly, a seventh area of improvement for conventional umbrellas is the accommodation of individual taste as to the aesthetic and visual aspects (appearance) of the umbrella, most significantly the canopy thereof. Permitting the individual consumer to design the canopy of the umbrella, and affording a wide range of design choices to that end, would be desirable. Permitting the user to redesign the canopy at will over time would be still more desirable. (It may be noted that designing an umbrella so that the canopy is easily replaceable will not only help accommodate individual taste but also facilitate repair of the umbrella.)

SUMMARY OF THE INVENTION

The present invention addresses the problems of conventional umbrellas discussed above.

According to a first aspect of the present invention, an umbrella includes a staff assembly, a plurality of upper ribs, a plurality of lower ribs corresponding to the plurality of upper ribs, respectively, and a canopy. The staff assembly includes a first or inner staff member having a proximal end and a distal end longitudinally opposite the proximal end, and a second or outer staff member having a proximal end and a distal end longitudinally opposite the proximal end. The outer staff member is slidably mounted on the inner staff member. The plurality of upper ribs are pivotally connected, at respective inner ends thereof, to the proximal end of the inner staff member. The plurality of lower ribs are pivotally connected, at respective inner ends thereof, to the proximal end of the outer staff member and, at respective outer ends thereof, to outer ends of corresponding ones of the plurality of upper ribs. The canopy is connected to the upper ribs or lower ribs. By virtue of the pivotal connections, the upper and lower ribs are adapted for conjoint swinging motion thereof between a deployed position in which the upper and lower ribs and the canopy extend substantially radially outwardly from the staff assembly so as to open the umbrella, and a retracted position in which the upper and lower ribs lie substantially parallel to, and the canopy is collapsed inwardly toward, the staff assembly so as to close the umbrella. By virtue of the connections of the canopy, the canopy is adapted for conjoint motion with the upper or lower ribs between the deployed position and the retracted position. When the umbrella is closed, the umbrella can be opened by moving the distal ends of the inner and outer staff members toward each other in the longitudinal direction, causing the inner ends of the upper and lower ribs to move apart from each other in the longitudinal direction, whereby the canopy and the outer ends of the upper and lower ribs are shifted into the deployed position. When the umbrella is opened, the umbrella can be closed by moving the distal ends of the inner and outer staff members away from each other in the longitudinal direction, causing the inner ends of the upper and lower ribs to move toward each other in the longitudinal direction, whereby the canopy and the outer ends of the upper and lower ribs are shifted into the retracted position.

According to a second aspect of the present invention, in the umbrella according to the first aspect each of the upper ribs is longer than each of the lower ribs.

According to a third aspect of the present invention, the umbrella according to the first aspect includes no additional ribs connected to the upper or lower ribs.

According to a fourth aspect of the present invention, in the umbrella according to the first aspect the inner and outer staff members are telescoping members with respect to each other. The outer staff member is longer than each of the lower ribs whereby, when the umbrella is in a closed state such that the upper and lower ribs are in the retracted position in which the upper and lower ribs lie substantially parallel to the staff assembly, the outer staff member extends longitudinally from a point at which the inner ends of the lower ribs are connected to the outer staff member beyond a point at which the outer ends of the upper and lower ribs abut the outer staff member, thereby providing a distal portion of the outer staff member, longitudinally opposite to a center of the canopy, the distal portion being capable of being grasped by a user's hand for holding, opening or closing the umbrella unimpeded by the upper and lower ribs.

According to a fifth aspect of the present invention, in the umbrella according to the first aspect each of the upper and lower ribs is an unjointed member.

According to a sixth aspect of the present invention, in the umbrella according to the first aspect the plurality of upper ribs nests inside the plurality of lower ribs or the plurality of lower ribs nests inside the plurality of upper ribs as the umbrella is closed.

According to a seventh aspect of the present invention, in the umbrella according to the first aspect the canopy may be disposed (a) between the plurality of upper ribs and the plurality of lower ribs, (b) on a side of the plurality of lower ribs that is farthest from the plurality of upper ribs, or (c) on a side of the plurality of upper ribs that is farthest from the plurality of lower ribs.

According to an eighth aspect of the present invention, in the umbrella according to the first aspect peripheral portions of the canopy are connected to the outer ends of the upper or lower ribs.

According to a ninth aspect of the present invention, in the umbrella according to the first aspect at least some of the connections between the inner ends of the upper ribs and the inner staff member, between the inner ends of the lower ribs and the outer staff member, between the outer ends of the lower ribs and the outer ends of the upper ribs, and between the canopy and the outer ends of the upper or lower ribs are releasable.

According to a tenth aspect of the present invention, in the umbrella according to the first aspect the canopy comprises a plurality of canopy pieces, each of the canopy pieces being connected to at least one other piece and/or one of the ribs.

According to further aspects of the present invention, an umbrella may include various features selected from among those defining the first through tenth aspects of the present invention.

A better understanding of these and other aspects, features, and advantages of the invention may be had by reference to the drawings and to the accompanying description, in which preferred embodiments of the invention are illustrated and described.

BRIEF DESCRIPTION OF THE DRAWINGS

FIG. 5B is a partially exploded view showing a connection between a rib and a rib connector.

Throughout the figures, like or corresponding reference numerals are used to identify like or corresponding parts.

DETAILED DESCRIPTION OF THE PREFERRED EMBODIMENTS

Figure 4:
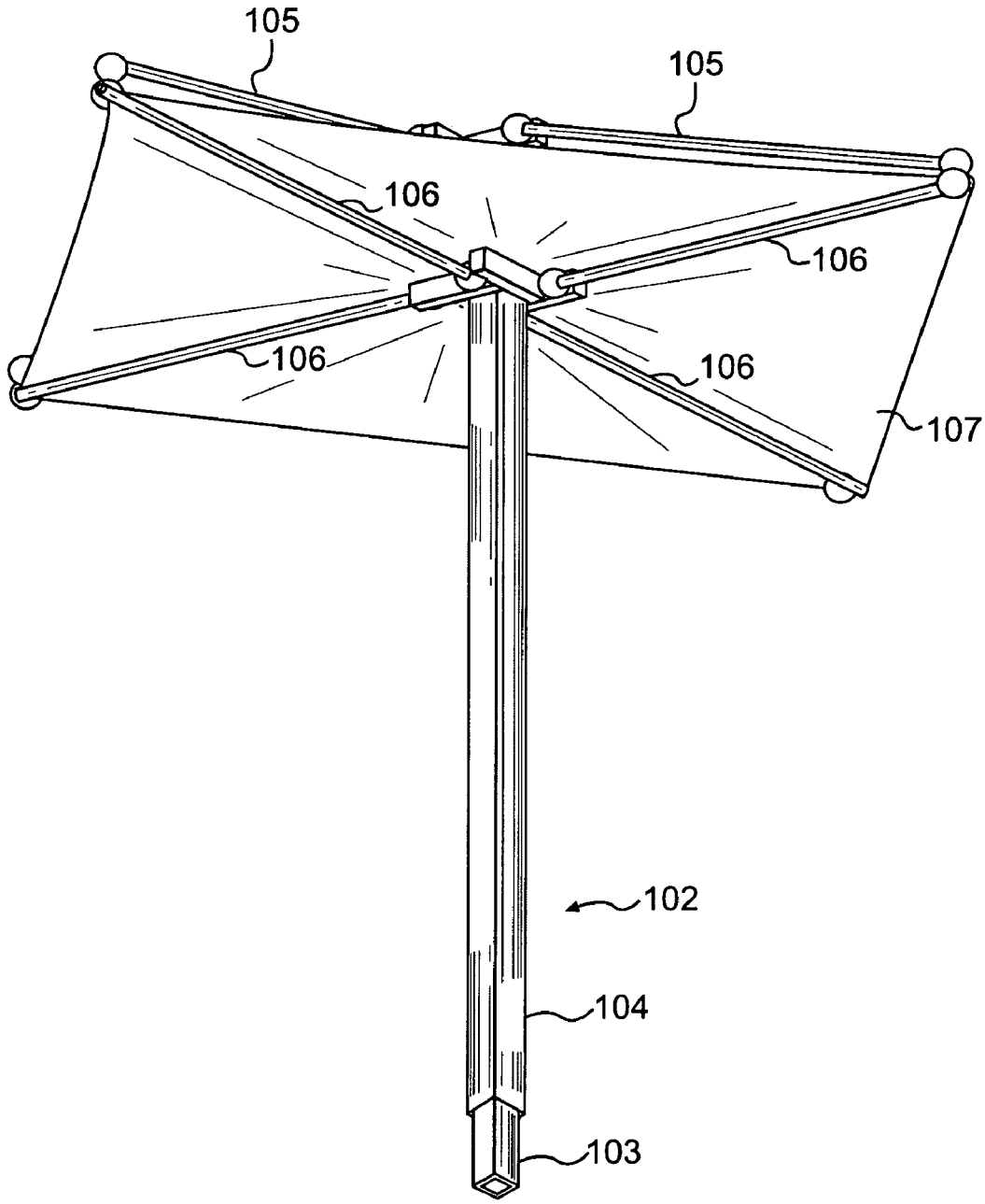
FIG. 4 is a perspective view of an umbrella according to an embodiment of the present invention, in an open state.
Figure 5A:
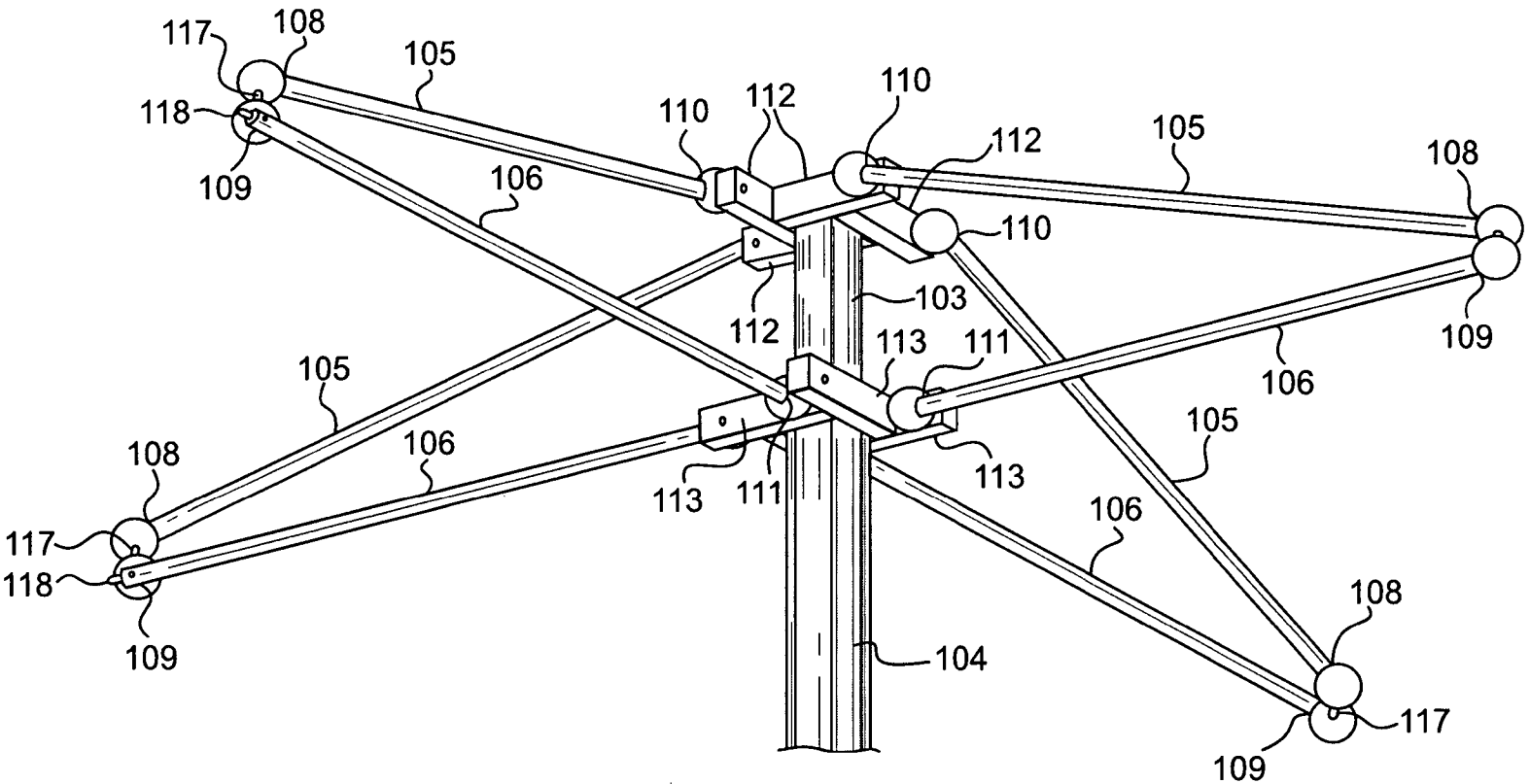
FIGS. 5A and 5B are fragmentary perspective views showing the upper portion of the umbrella shown in FIG. 4, with the canopy omitted.

An exemplary embodiment of the present invention will be discussed with reference to the accompanying figures. First, basic aspects of the structure of an umbrella according to the invention will be described with reference to FIGS. 4, 5A and 5B, 7 and 9-11. As shown in FIGS. 4 and 5A, an umbrella includes a staff assembly 102, a plurality of upper ribs or rib-like members 105 and lower ribs or rib-like members 106, and a canopy 107, which are interconnected, as will be explained below.

Staff assembly 102 includes a first or an inner staff member 103 and a second or outer staff member 104 slidably mounted with inner staff member 103 for relative axial movement. In the preferred embodiment the inner staff member 103 is mounted in telescoping fashion within the outer staff member 104. Although in this exemplary embodiment outer staff member 104 has a length well over half (e.g., approximately 75-80% of) the length of inner staff member 103, the umbrella may be so designed that outer staff member 104 is longer or shorter.

Figure 8A:
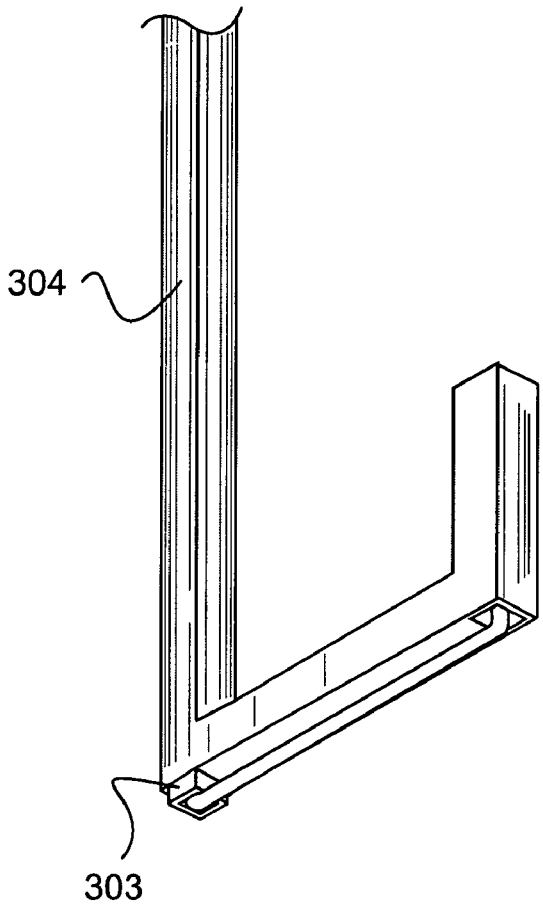
FIGS. 8A and 8B are fragmentary perspective views of an umbrella according to still another embodiment of the present invention, in which the inner and outer staff members are formed as telescoping J-shaped members forming a J-shaped handle.
Figure 8B:
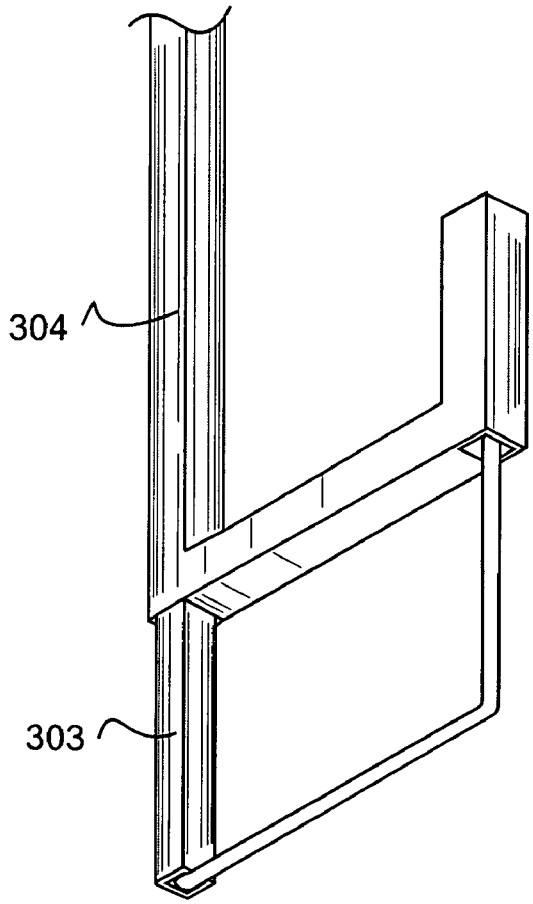

(It should be noted that, with the exception of the particular embodiment shown in FIGS. 8A and 8B, the figures do not necessarily show the full extent of the bottom portion of the umbrella according to the invention. Specifically, e.g., inner staff member 103 may be extended as desired and, in particular, a handle may be added thereto or formed therein, in any of various ways, as will be appreciated by those of ordinary skill in the art.)

Upper ribs 105 and lower ribs 106 are connected at their inner ends to inner staff member 103 and outer staff member 104, respectively. Upper ribs 105 and lower ribs 106 are connected at their outer ends to each other. These connections serve both as fasteners, i.e., to secure the respective members together (in a preferably releasable fashion), and as hinges or pivots, i.e., to provide for swinging or pivoting motion of the respective members relative to each other. Examples of these connections are as follows.

Figure 5B:
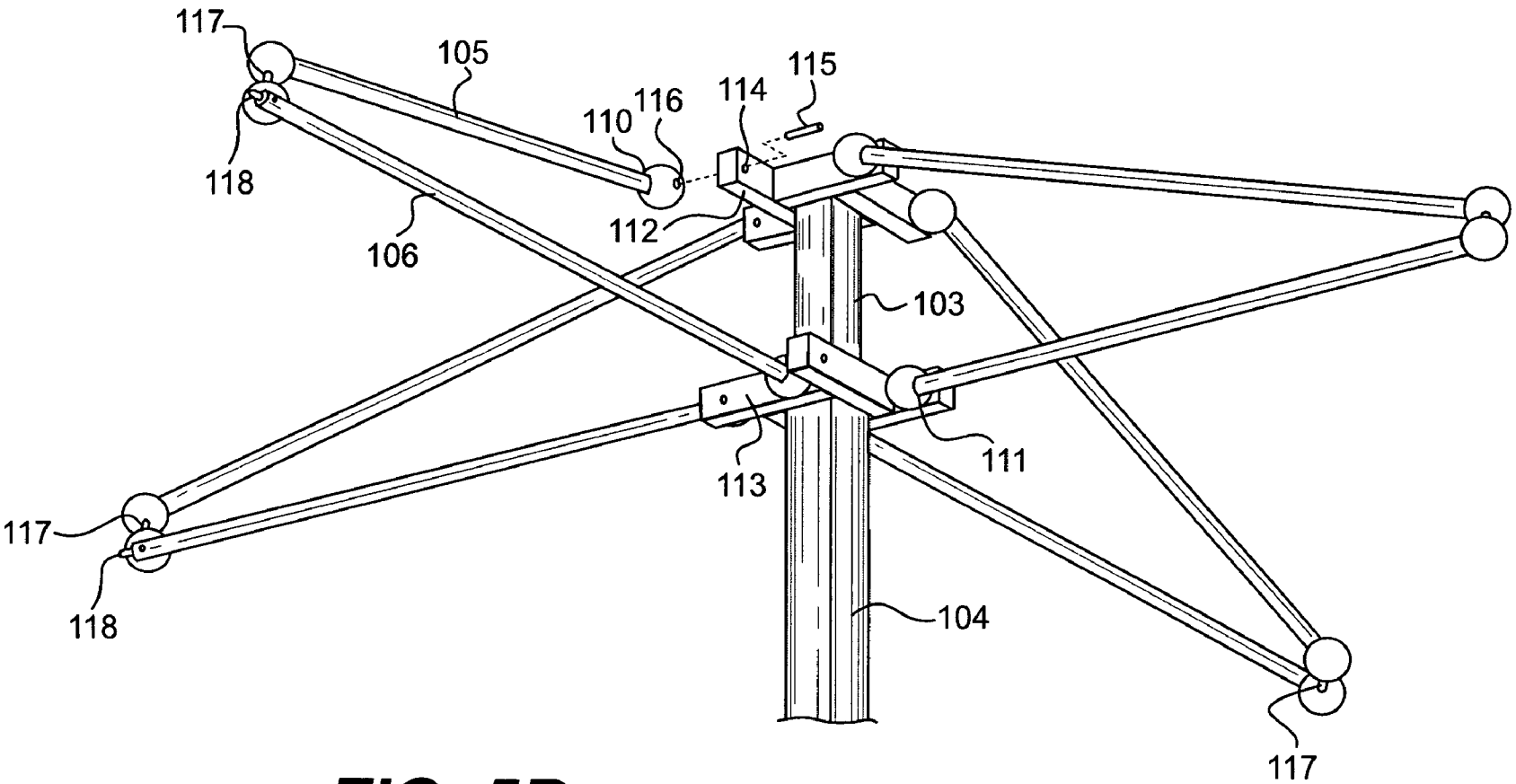

As shown in FIG. 5A, inner staff member 103 has four rib connectors 112 each connected to an inner end 110 of an upper rib 105. Rib connectors 112 may be formed, for example, as lateral projections from inner staff member 103, formed integrally therewith. In this example, as seen in FIG. 5B, each rib connector 112 includes a hole 114 through which a pivot pin 115 is rotatably disposed. Each pivot pin 115 extends through a corresponding hole 116 in inner end 110 of a corresponding upper rib 105. It will thus be seen that each upper rib 105 is pivotably connected (via a rib connector 112) to inner staff member 103, for swinging motion of the respective upper rib 105 in the vertical plane defined by the respective upper rib 105 and the inner staff member 103.

Each upper rib 105 is also releasably secured to corresponding rib connector 112, and thence to inner staff member 103, via associated pivot pin 115. For example, each pivot pin 115 may be a screw, which is screwed into hole 114 of rib connector 112 and/or hole 116 of inner end 110 of upper rib 105. In this case, at least one of the two holes 114 and 116 should be threaded, but pivot pin 115 may be permanently fixed in the other hole if desired. As an alternative mode of releasable connection (not shown), pivot pin 115 could be provided with a hole at each end thereof, extending transversely to the longitudinal axis of pivot pin 115, and a locking pin could be releasably inserted in each hole. Thus, by virtue of any appropriate means, such as the examples given, each upper rib 105 is secured to inner staff member 103, as is desired under normal circumstances of use or storage of the umbrella, while also being easily releasable therefrom (by unscrewing pivot pin 115, removing the locking pin, etc., as the case may be) for purposes of, e.g., repair or replacement of a rib.

Like inner staff member 103, outer staff member 104 also has four rib connectors 113 each connected to an inner end 111 of lower rib 106. In this example, the construction of the connections between lower ribs 106 and outer staff member 104 (via rib connectors 113), is the same as that of the connections between upper ribs 105 and inner staff member 103, i.e., involving holes in rib connectors 113, pivot pins, and holes in inner ends 111 of lower ribs 106, and accordingly is not fully illustrated. Of course, these connections may be varied, as was discussed above with respect to the connections between upper ribs 105 and inner staff member 103. Accordingly, each lower rib 106 may be pivotably connected (via a rib connector 113) to outer staff member 104, for swinging motion of the lower rib 106 in the vertical plane defined by the respective lower rib 106 and outer staff member 104. Each lower rib 106 is also releasably secured to outer staff member 104.

Similar to the connections between the inner ends of the ribs and the staff members, the outer ends of the ribs are also releasably secured and pivotably connected to each other, permitting swinging motion of the ribs in the indicated vertical planes. Specifically, for example, as shown in FIGS. 5A and 5B, outer ends 108 of upper ribs 105 and outer ends 109 of lower ribs 106 may be provided with holes, respectively, through which respective pivot pins 117 are rotatably disposed so as to permit the indicated swinging motion. Pivot pins 117 are also appropriately formed (e.g., as screws, having locking pins, etc.) so as to releasably attach each pair of corresponding upper and lower ribs at their outer ends. (Since these connections are also similar to those between upper ribs 105 and inner staff member 103, they are not fully illustrated.)

The particular details of the connections (including both the pivoting and the releasable attachment functions) between the inner ends of the ribs and the respective staff members, and between the outer ends of the respective upper and lower ribs, need not be as described above but may be varied in any suitable manner, as will be appreciated by those of ordinary skill in the art, so long as attachment and pivotal connections of the respective members are provided, permitting swinging motion of the ribs in their respective vertical planes (the respective vertical plane of a rib being the vertical plane defined by the rib and the staff member to which it is connected). While releasability of the attachment of the various structural elements is understood to be desirable for many applications, the umbrella according to the invention may also be structured in such a way that any or all of the various connections are fixed and not (or not easily) releasable.

It should also be noted that while, according to this embodiment, the umbrella is provided with four upper ribs 105 and four lower ribs 106, i.e., four pairs of ribs for a total of eight ribs, other embodiments of the invention are envisioned in which the number of pairs of upper and lower ribs is five, six, seven or eight (the total number of ribs being ten, twelve, fourteen or sixteen). Of course, the invention is not limited to these examples and may have fewer than four or more than eight pairs of ribs. Connected pairs of corresponding upper and lower ribs are preferably evenly spaced apart radially, i.e., so as to form equidistant arcs between each pair.

Figure 6:
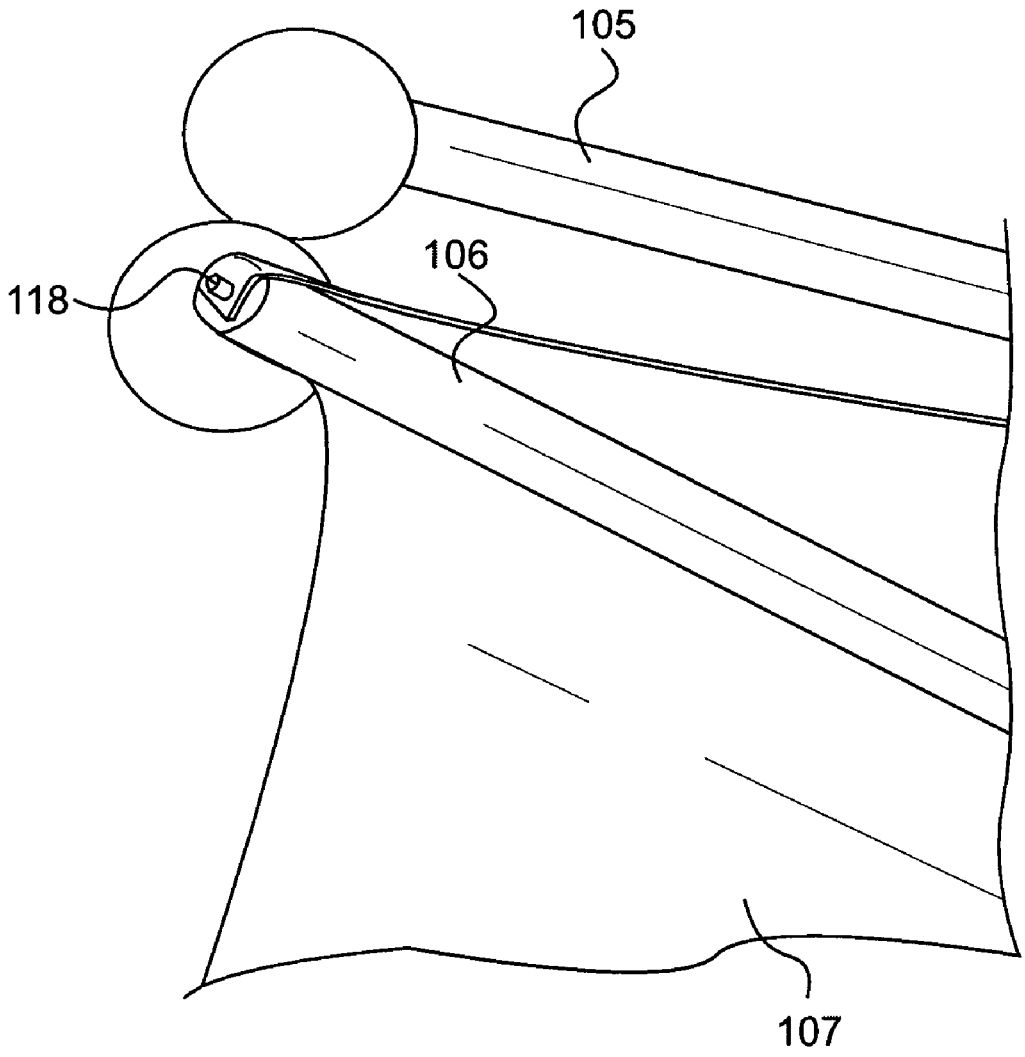
FIG. 6 is a fragmentary perspective view of the umbrella shown in FIG. 4, showing a connection between the canopy and a rib.

As shown, e.g., in FIG. 4, the umbrella further includes a canopy 107 generally of a circular or polygonal shape and composed of a fabric, plastic or other flexible material. If polygonal in shape, the number of sides of canopy 107 may correspond to the number of pairs of ribs. The compositional material of canopy 107 is preferably waterproof or water-resistant. As shown, e.g., in FIG. 6, canopy 107 is removably attached to upper ribs 105 or lower ribs 106, for example, by threaded lugs 118 projecting from the outer ends of the ribs, which are inserted into corresponding holes in the periphery of canopy 107 and may be provided with matchingly threaded caps (not shown), or by any other suitable fastening means, such as will be appreciated by those of ordinary skill in the art. Of course, while easy detachability of canopy 107 is believed to be desirable for many applications of the invention, it is not to be taken as a required feature thereof. The center of canopy 107 is provided with a hole or otherwise cut out as necessary to accommodate staff assembly 102. By virtue of the connection of canopy 107 to the upper or lower ribs, the canopy will move conjointly with the ribs when the ribs are extended or retracted to open and close the umbrella, respectively, as explained below.

Although FIG. 4 shows canopy 107 disposed between lower ribs 106 and upper ribs 105, canopy 107 may alternatively be disposed below lower ribs 106 or above upper ribs 105, as desired (and in either case by similar means of connection). The umbrella may be designed so that the location of canopy 107 vis à vis the ribs is selected by the manufacturer and/or by the buyer, as the manufacturer sees fit. Regardless of whether the umbrella is manufactured so that the user can select the location of canopy 107, canopy 107 may be easily removed and replaced by virtue of the above-described mode of connection between the canopy and the ribs. The manufacturer may make different canopies available in different designs, so that the user may redesign the umbrella over time by exchanging the canopy.

Figure 7A:
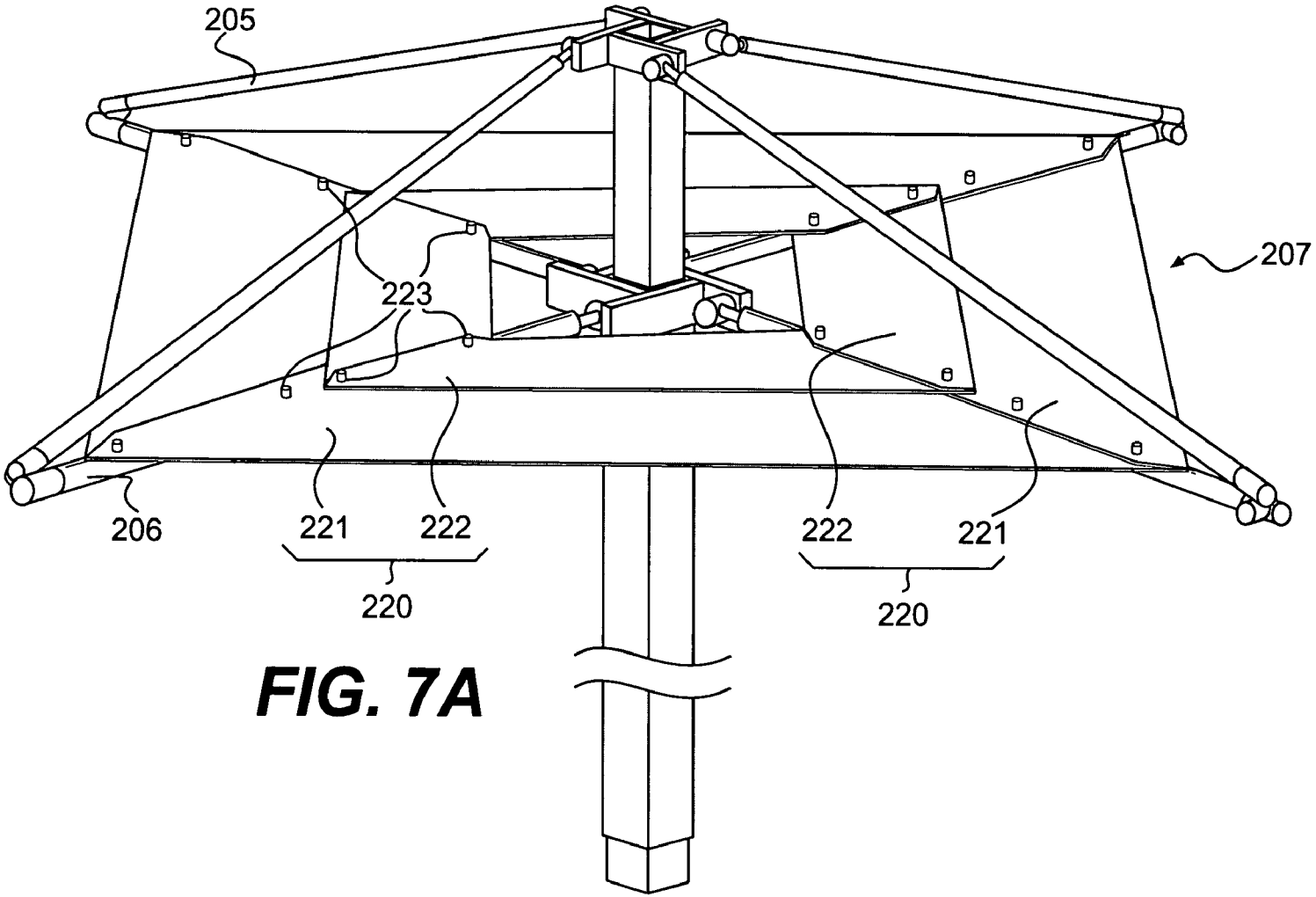
FIG. 7A is a perspective view of an umbrella according to another embodiment of the present invention, in which the canopy is formed of a plurality of connected canopy pieces, the umbrella being shown in an open state.
Figure 7B:
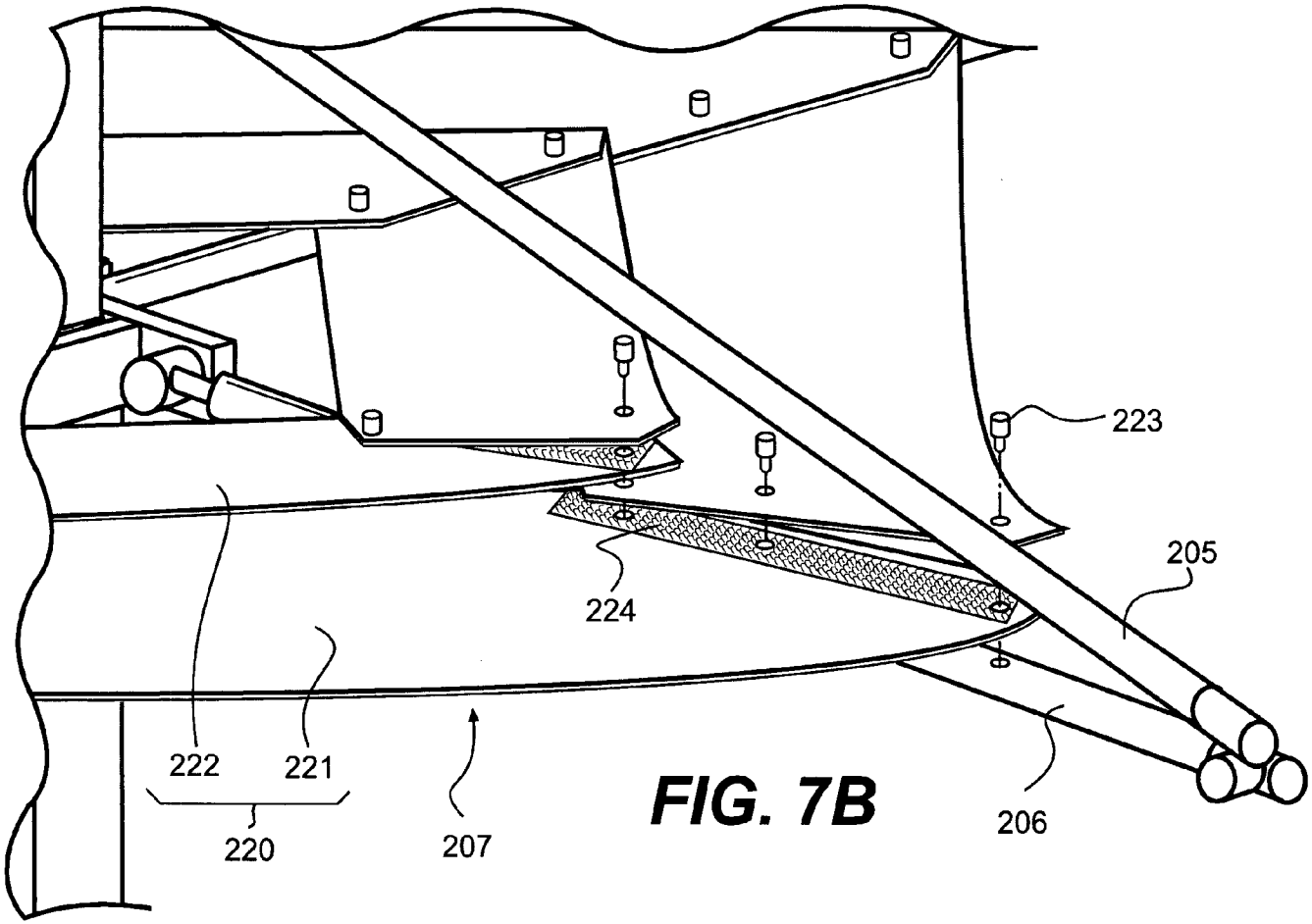
FIG. 7B is a fragmentary perspective view of the umbrella shown in FIG. 7A, showing connections between different canopy pieces and between canopy pieces and a rib.

The scope of user design of the umbrella is expanded in another embodiment of the invention, shown in FIGS. 7A and 7B. According to this embodiment, canopy 207 is comprised of separate pieces or membrane strips 220, which are connected together to form canopy 207. In the illustrated example, each strip 220 extends between two adjacent ribs. Adjacent strips 220 may be connected to each other by means of hook and loop fasteners 224, and outer strips 221 and inner strips 222 may overlap each other in the widthwise direction. Canopy 207 formed by strips 220 is in this example disposed between lower ribs 206 and upper ribs 205, and attached to lower ribs 206. Lower ribs 206 are provided with lugs 223 for removably securing strips 220 to lower ribs 206. Lugs 223 project toward the corresponding upper ribs 205, and may be formed, e.g., as screws with caps integrally formed thereon for easy securing and releasing of strips 220. Unlike the above-described embodiment, in which the lugs are provided only at the outer ends of the ribs, here each lower rib 206 is provided with a plurality of lugs 223 at multiple points, respectively, along its length, so that each strip 220 is attached to a rib at multiple points.

According to this embodiment, users may easily design their own umbrella (canopy) and change the design over time, enjoying the aesthetic and other benefits attendant thereto. Outer strips 221, being all of the same size, are interchangeable with each other. Inner strips 222, also being all of the same size, are also interchangeable with each other. All of the strips 220 are easily attachable to and detachable from both each other and lower ribs 206, as little effort or instruction is required to operate the fasteners. The manufacturer may make strips 220 available in different colors, patterns and the like, as well as custom designs, so as to afford a wide range of choice to customers wishing to design their own umbrella.

Similarly to the previous embodiment, here too the particular details of the connections between different strips and between strips and ribs are not limited to those described and illustrated herein, but may be varied in any suitable manner, as will be appreciated by those of ordinary skill in the art, so long as they accomplish their (preferably releasable) attachment function. The size and shape of the strips may also be suitably varied. In addition, the overlapping feature may be suitably varied or eliminated. Fasteners may be provided along the widthwise edges of adjacent strips 220. As above, while easy detachability of strips 220 from each other and form the ribs is believed to be desirable for many applications of this embodiment of the invention, it is not to be taken as a required feature thereof.

In addition to the above components, the umbrella according to the present invention may generally include any other features known in the art, such as, but not limited to, features that would be deemed standard or common for umbrellas. For example, the umbrella of the invention may be provided with catches to releasably lock the outer staff member in place vertically with respect to the inner staff member, in open and closed positions of the umbrella, respectively.

As another example of such features, the umbrella may be provided with a suitable handle, e.g., at the bottom of the staff assembly. The bottom of the staff assembly itself may be designed, e.g., by modifying its shape, to serve as such a handle. A particular example of such a handle is shown in the alternative embodiment illustrated in FIGS. 8A and 8B. As shown therein, outer staff member 304 and inner staff member 303 are formed as matching telescoping J-shaped members. The bottom curved portion of the J-shaped portion of inner staff member 303 is designed to be grasped for opening and closing the umbrella. When the umbrella is in the open state (FIG. 8A), the J-shaped portion of inner staff member 303 telescopes into the matching J-shaped portion of outer staff member 304, except for a small portion at the bottom of the J-shaped portion of inner staff member 303 that remains outside of the J-shaped portion of outer staff member 304, for the purpose of grasping inner staff member 303 to pull it downward to close the umbrella. FIG. 8B shows the handle in the closed state of the umbrella.

Of course, other embodiments of the umbrella of the present invention may be provided with a handle, not necessarily of the kind shown in FIGS. 8A and 8B, but of any kind, as will be understood by those of ordinary skill in the art. As noted previously, with the exception of the particular embodiment shown in FIGS. 8A and 8B, the figures do not necessarily show the full extent of the bottom portion of the umbrella according to the invention. Not only may a specifically formed handle be provided, but the inner staff member may simply be extended to serve as a handle or for other reasons. Thus, the bottom portion of the umbrella may be modified or added to as desired, in any of various ways, as will be appreciated by those of ordinary skill in the art. It is understood that it will often be desirable that the portion of the inner staff member that extends downward beyond the outer staff member be of sufficient length and be sufficiently unencumbered by modifications or additions so as be able to serve as a handle or grasping portion for the purpose of holding, opening and closing the umbrella.

The structural and operational arrangements of catches, handles, and other such features as may desirably or appropriately be provided in an umbrella, are known to those of ordinary skill in the art and hence their description will be omitted.

Operation of the umbrella will now be described with reference to FIGS. 9-11.

Figure 9:
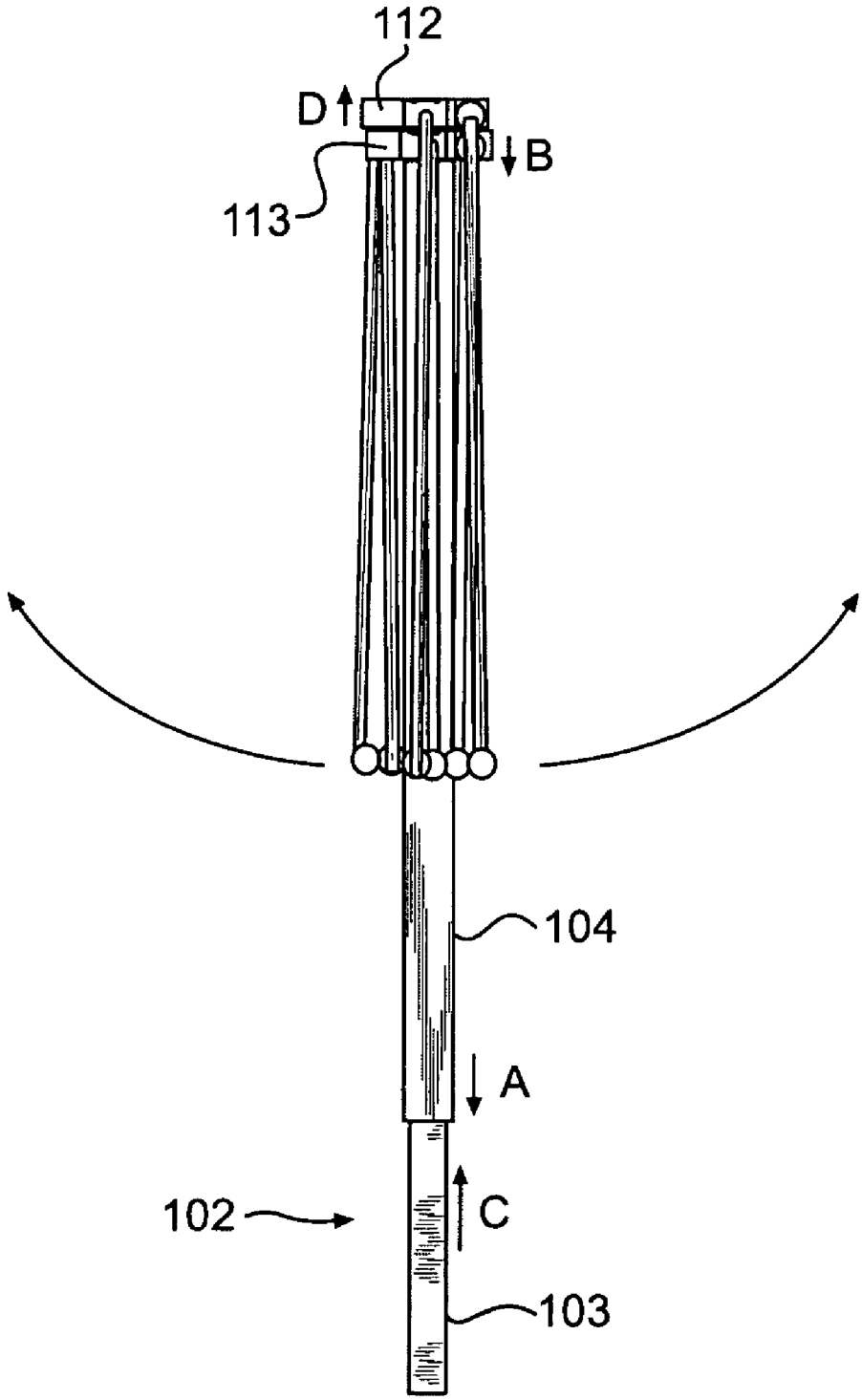
FIG. 9 is an elevational view of the umbrella shown in FIG. 4, in a closed state, with the canopy omitted.
Figure 10:
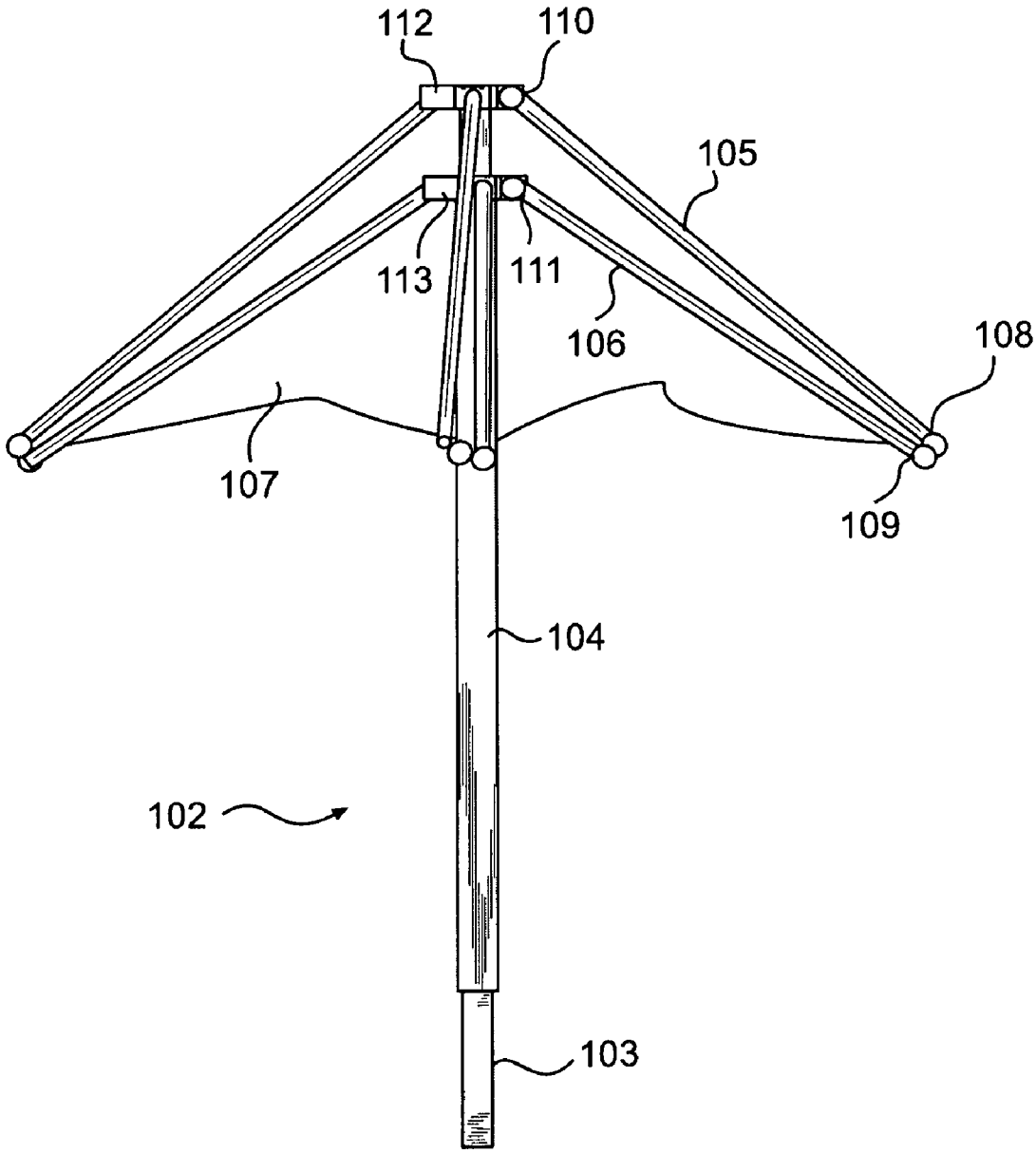
FIG. 10 is an elevational view of the umbrella shown in FIG. 4, in an intermediate state between the open state and the closed state.

In the closed position, as shown in FIG. 9, ribs 105 and 106 are folded down and inwardly with respect to staff assembly 102 and lie with their longitudinal axes substantially parallel to that of staff assembly 102. Canopy 107 (not shown in FIG. 9) is likewise collapsed against ribs 105 and 106 and staff assembly 102.

In the open position, as shown in FIG. 1, ribs 105 and 106 are extended upward and radiate out from staff assembly 102 in an orientation relatively near the horizontal, their longitudinal axes angled slightly from the perpendicular to the longitudinal axis of staff assembly 102. In the open position, canopy 107 forms a slightly domed shape. The extent to which the ribs 105 and 106 deviate from the horizontal, and the corresponding extent to which canopy 107 is domed, may be varied from that shown in the figures.

To open the umbrella from a closed position, outer staff member 104 is pulled down relative to inner staff member 103 (arrow A in FIG. 9), causing inner ends 111 of lower ribs 106 to move downward relative to inner staff member 103 (arrow B in FIG. 9) (or, equivalently, inner staff member 103 is pushed up relative to outer staff member 104 (arrow C in FIG. 9), causing inner ends 110 of upper ribs 105 to move upward relative to outer staff member 104 (arrow D in FIG. 9)). This movement causes outer ends 108, 109 of ribs 105, 106 to move upward and outwardly with respect to staff assembly 102 and canopy 107 to spread open. That is, the upper ribs 105 pull the outer ends 109 of the lower ribs 106 upwardly and outwardly to spread the canopy 107. For clarification, FIG. 10 shows the umbrella in an intermediate state between the closed state shown in FIG. 9 and the open state shown in FIG. 11.

To close the umbrella from the open position, the reverse operation is performed. That is, outer staff member 104 is pushed up relative to inner staff member 103 (arrow A in FIG. 11), causing inner ends 111 of lower ribs 106 to move upward relative to inner staff member 103 (arrow B in FIG. 11) (or, equivalently, inner staff member 103 is pulled downward relative to outer staff member 104 (arrow C in FIG. 11), causing inner ends 110 of upper ribs 105 to move downward relative to outer staff member 104 (arrow D in FIG. 11). This movement causes outer ends 108, 109 of ribs 105, 106 to move downwardly and inwardly with respect to staff assembly 102 and canopy 107 to collapse inwardly.

It is also possible to provide the umbrella of the present invention with mechanical means for relatively moving the inner and outer staff between the open and closed positions. Such mechanical means take the form of, for example, a rack and pinion gear arrangement, a spring motor, or equivalent structures.

By virtue of its structure and consequent mode of operation, the umbrella according to the present invention provides a number of advantages. These advantages will be best appreciated in view of certain additional structural aspects or considerations of the design of the umbrella and their attendant operational consequences, as contrasted with the prior art.

As discussed above with reference to FIG. 1A-1D, a conventional umbrella is characterized structurally by staff 3, ring 4, upper ribs 5, lower ribs 6 and canopy 7. The basic structure of the conventional umbrella differs in several significant respects from that of the umbrella of the present invention. First, in the conventional umbrella lower ribs 6 are relatively close to half the length of upper ribs 5, while according to the present invention the lower ribs are relatively close to the full length of the upper ribs. Second and relatedly, in the conventional umbrella lower ribs 6 are connected at their outer ends 9 to positions relatively near the midpoints M of upper ribs 5, while according to the present invention the lower ribs are connected at their outer ends to the outer ends of the upper ribs. Third, as discussed above, the conventional umbrella includes staff 3 and ring 4 slidingly mounted thereon, while the umbrella according to the present invention has a staff assembly including an outer staff member relatively close in length to an inner staff member, the outer staff member being slidingly mounted on the inner staff member in telescopic fashion.

The basic operation of the conventional umbrella also differs in several significant respects from that of the umbrella of the present invention. First, the conventional umbrella is opened and closed by sliding the ring (or staff) in the direction opposite to that in which the inner staff member (or outer staff member) is slid in the present invention. That is, to open the conventional umbrella the ring is slid upward (or the staff is slid downward), while to close the conventional umbrella the ring is slid downward (or the staff is slid upward). According to the present invention, to open the umbrella the outer staff member is slid downward (or the staff is slid upward), and to close the umbrella the outer staff member is slid upward (or the inner staff member is slid downward). Second, the movement of the lower ribs in opening and closing the conventional umbrella is opposite to that of the present invention. That is, when the conventional umbrella is opened, the inner ends of the lower ribs are shifted upward; in contrast, when the umbrella according to the present invention is opened, the inner ends of the lower ribs are shifted downward. Similarly, when the conventional umbrella is closed, the inner ends of the lower ribs are shifted downward, while, when the umbrella according to the present invention is closed, the inner ends of the lower ribs are shifted upward.

Figure 11:
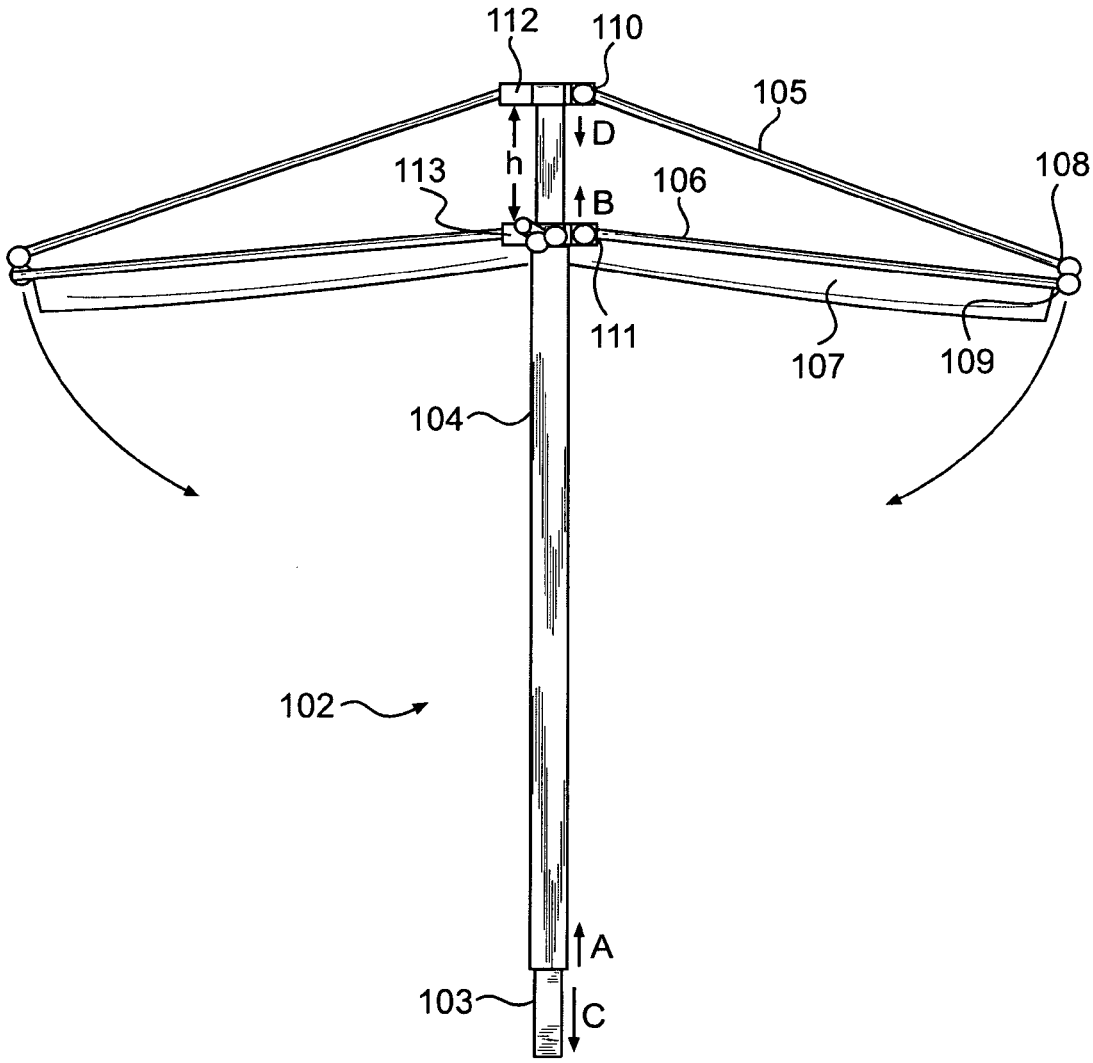
FIG. 11 is an elevational view of the umbrella shown in FIG. 4, in the open state.

According to the present invention, when the umbrella is in the open state, as shown in FIG. 11, a triangle is formed by each pair of corresponding upper and lower ribs together with the portion of the staff assembly between the inner ends of the pair of ribs. The longest leg of the triangle is constituted by an upper rib, the second longest leg is constituted by a lower rib, and the shortest leg is constituted by the portion of the staff assembly between the inner ends of the upper and lower ribs. The second longest leg is relatively close in length to the longest leg; that is, as noted, the lower rib 106 is relatively close in length to the upper rib 105. For example, the length of the lower rib may be equal to approximately 85% or more of the length of the upper rib, although this proportion is not required. The length of the shortest leg is quite small compared to the lengths of the two longer legs.

In view of this geometry, it will be seen that, to the extent that the three members constituting the legs of the triangle are rigid and do not break, the umbrella will not turn inside out. In this regard, it is noted that inner staff member 103, outer staff member 104, and each one of upper ribs 105 and lower ribs 106 is preferably an unjointed member. To be sure, large-scale umbrellas will permit the use of heavier, stronger materials for their component parts than will personal umbrellas. Accordingly, while large-scale umbrellas may be formed with substantially rigid staff members and with at least the lower rib being substantially rigid, the corresponding members of personal umbrellas may be expected to admit of some degree of flexibility. Indeed, it is possible to form the upper ribs as cables rather than rigid members because in opening the umbrella they act substantially in tension to pull the lower ribs upwardly and outwardly as described above. And when in tension with the umbrella in the open position, such upper ribs in the form of cables can support the canopy. Nonetheless, designing the lower ribs to have lengths relatively close to that of the upper ribs, and to be connected at their outer ends to the outer ends of the upper ribs, is understood to provide a more rigid overall structure, and hence greater stability in the wind and greater durability over time, as compared to prior art structures.

In the conventional umbrella, although a lower rib, a corresponding upper rib and the portion of the staff extending between their inner ends also forms a triangle, the structure may not be effective, e.g., in preventing the outer portion of the upper ribs and canopy (i.e., the portion lying radially beyond the ends of the lower ribs) from being turned inside out.

Figure 12A:
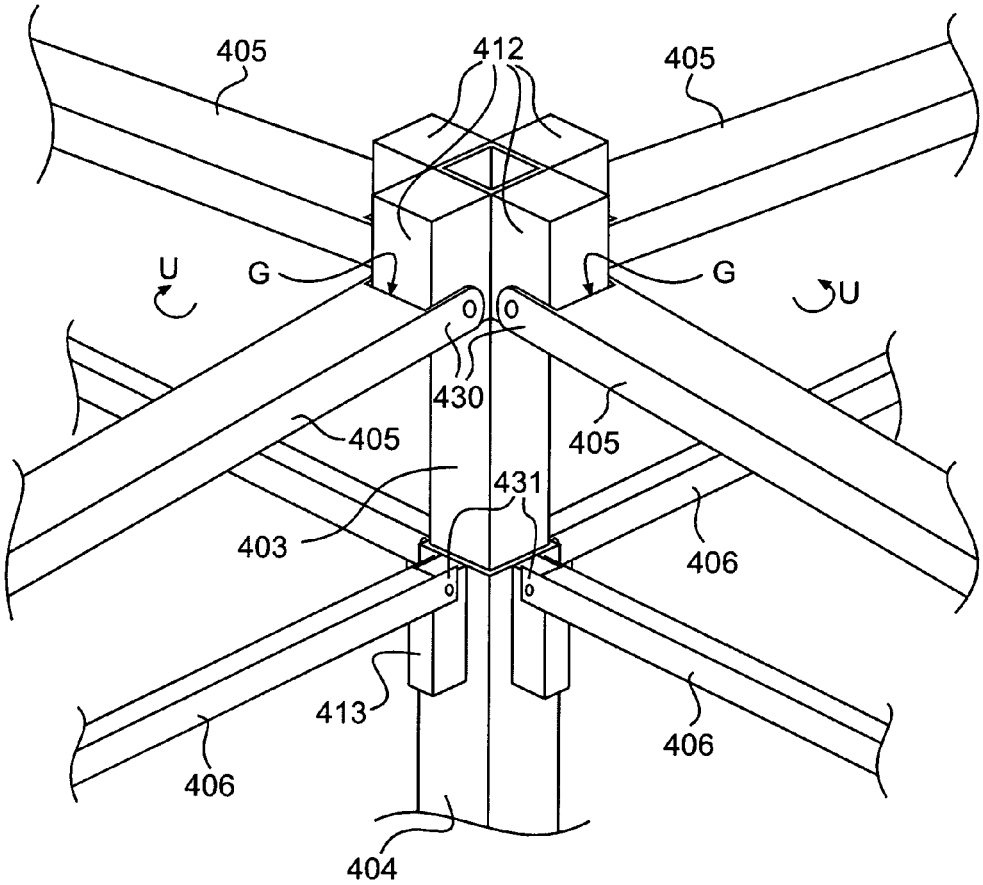
FIGS. 12A and 12B are fragmentary perspective views of an umbrella according to still another embodiment of the present invention, in which the upper and lower ribs are formed as nesting members having ears for connecting to the rib connectors.

According to the umbrella of the present invention, since as noted the members may have some flexibility, additional means for maintaining stability in the wind may be provided. For example, the connection between rib and staff member, in addition to functioning as a fastener and hinge, as discussed above, may also be designed to limit the upward motion of the ribs, so as to help prevent the umbrella from being turned inside out. An example of this is seen in FIG. 12A, which illustrates another embodiment of the invention (discussed more fully below). As shown in FIG. 12A, upper ribs 405 and lower ribs 406 are aligned with rib connectors 412 and 413 (inner and outer staff members 403 and 404), respectively, rather than being offset therefrom and attached at the sides of the rib connectors as in the embodiment shown in FIGS. 5A and 5B. Upper ribs 405 and lower ribs 406 are connected to rib connectors 412 and 413, respectively, by ears 430 and 431. In the case of upper ribs 405, the clearance or gap G between the inner end of each upper rib 405 and the corresponding rib connector 412 is made sufficiently small as to prevent upper ribs 405 from swinging upward (in the direction indicated by arrows U) beyond the position in which upper ribs 405 extend in a horizontal plane perpendicular to inner staff member 403. Of course, this function of limiting the upward swinging motion of the ribs may be accomplished by alternative structural arrangements, as will be appreciated by those of ordinary skill in the art.

According to the umbrella of the present invention, by virtue of the structural and operational arrangement of the upper and lower ribs and the staff assembly, and the relative proportions among the three legs of the triangle they form, as described above, the distance which must be traversed by the inner or outer staff member in order to open or close the umbrella is quite short. Specifically, the distance is equal to the length h of the shortest leg of the triangle (see FIG. 11). That is, the user will have to move the inner or outer staff member only the distance h of the shortest leg in order to open or close the umbrella.

This travel distance that the user must move the staff member to open or close the umbrella is significantly shorter than the equivalent distance required in the case of a conventional umbrella. The reason for this lies in the structure and operation of the conventional umbrella, which was described above. In order to open the conventional umbrella, the lower ribs must be shifted from their retracted state (FIG. 1D), in which they lie vertically, parallel to the staff assembly, with their inner ends near the bottom of the staff assembly, to their extended state (FIG. 1B), in which they radiate out from the staff assembly, lying approximately horizontally, approximately perpendicular to the staff assembly, with their inner ends near the top of the staff assembly. In order for the lower ribs to move from their retracted state to their extended state (FIG. 1B), the inner ends must thus be shifted upward from a position near the bottom of the staff assembly to a position near the top of the staff assembly. Specifically, in order to open the conventional umbrella, the inner ends of the lower ribs must be shifted upward along the staff a distance y relatively similar to the length of the lower ribs. The distance y is the distance that must be traversed by the ring (or, equivalently, by the staff) in order to open or close the umbrella or, in other words, the distance that the user must move the ring (or staff) in order to open or close the umbrella. (As noted, in FIG. 1B ring 4 is shown in dashed outline at the position it would be in if the umbrella were closed, and in FIG. 1D ring 4 is shown in dashed outline at the position it would be in if the umbrella were open.) Even though in the conventional umbrella the lower ribs are only approximately half as long as the upper ribs, still the length of the lower ribs, and hence the travel distance y required to open or close the umbrella, is significantly longer than the travel distance h required to open or close the umbrella according to the present invention.

The short travel distance h that the user must move the inner or outer staff member to open or close the umbrella of the present invention provides a number advantages. First, it may reduce the time and effort required to operate the umbrella. As discussed above, this is an advantage not only in terms of convenience but also in terms of basic functionality. For example, in the case of a personal umbrella, it will permit the umbrella to be opened more quickly, which can keep the user dry, and closed more quickly, which can help the user avoid impinging on third parties. In the case of large-scale umbrellas, although prompt operation may not be as necessary, the time savings may provide considerable benefit, since the travel distance, and hence the time, required to open and close these umbrellas is considerably greater than is the case with personal umbrellas. The time savings may be even more pronounced where the user must use a crank mechanism to operate the umbrella, since the crank handle must be rotated a distance significantly greater than the actual travel distance of the ring or staff member, and since the crank mechanism may be designed to be turned at a slow speed which, if exceeded, may subject it to increased risk of breakage.

Second, since the reduced travel distance reduces the extent to which the parts move in opening and closing the umbrella, this aspect of the design may have the effect of reducing stress and wear and tear, and hence improving durability and reducing the need for repairs.

Third, since the reduced travel distance increases the speed and facility with which the umbrella can be manually opened or closed, this aspect of the design reduces the need to provide the umbrella with automatic opening/closing means. As noted above, this in effect also addresses the problems of reparability and simplicity of manufacture, since a significant component of the conventional umbrella may be dispensed with.

U.S. Pat. No. 2,690,187 teaches a variant of the conventional umbrella described above. The '187 patent discloses an umbrella having a staff, a sleeve, upper brace ribs, lower frame ribs, connecting members, and a cover. The upper brace ribs and lower frame ribs are connected to each other at their outer ends. However, the connecting members are connected at their inner ends to the staff and at their outer ends to the lower frame ribs, at positions near the midpoints of the lower frame ribs. That is, the connecting members are arranged similarly to lower ribs 6 of the above-described conventional umbrella. By virtue of this similarity of arrangement, the connecting members are also seen to operate (in opening and closing the umbrella) in a manner similar to that of lower ribs 6 of the above-described conventional umbrella. Thus, despite having upper brace ribs and lower frame ribs connected at their outer ends, the umbrella of the '187 patent requires the user to move the sleeve a distance similar to that required by the above-described conventional umbrella to open or close the umbrella. Accordingly, the '187 patent does not achieve the short travel distance of the present invention and the advantages consequent thereto.

The problem of the inconvenience of operation of the conventional umbrella is also addressed by the present invention in the provision of a near-full-length outer staff member, in contrast to the mere ring of the conventional umbrella. Specifically, the long staff member solves the problem of excessive reach required (to raise and lower the ring) to open and close a conventional (esp. large-scale) umbrella. That is, in order to open or close a conventional umbrella, it is necessary to reach up inside the umbrella toward the canopy, either to raise the ring toward the canopy (to open the umbrella) or to grasp the ring from its uppermost position and pull it toward the bottom of the umbrella (to close the umbrella). As noted, this problem of reach may be particularly acute in the case of a large-scale umbrella lacking a manual assist mechanism, e.g., a beach umbrella, in view of the height of such an umbrella. According to the present invention, however, the long outer staff member extends toward the bottom of the umbrella, within easy reach of the user, whether the umbrella is in an opened or closed state. Whether opening or closing the umbrella, the user has to pull or push the outer or inner staff member only a short distance, and the staff member remains within easy reach along that entire distance.

In this regard, it is noted that the umbrella of the '187 patent has a sleeve similar to ring 4 of the above-described conventional umbrella. Consequently, the '187 patent does not achieve the benefits attributable to the near-full-length outer staff member of the present invention, such as the elimination of the problem of reach.

Figure 1A:
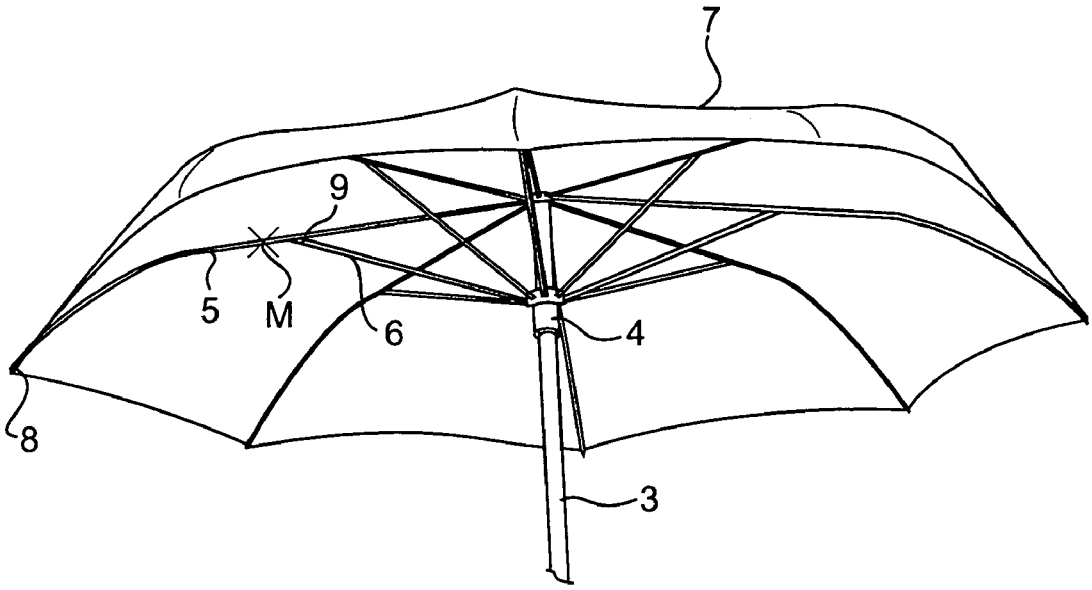
FIG. 1A PRIOR ART
FIG. 1A is a perspective view of a prior art umbrella in an open state.
Figure 1B:
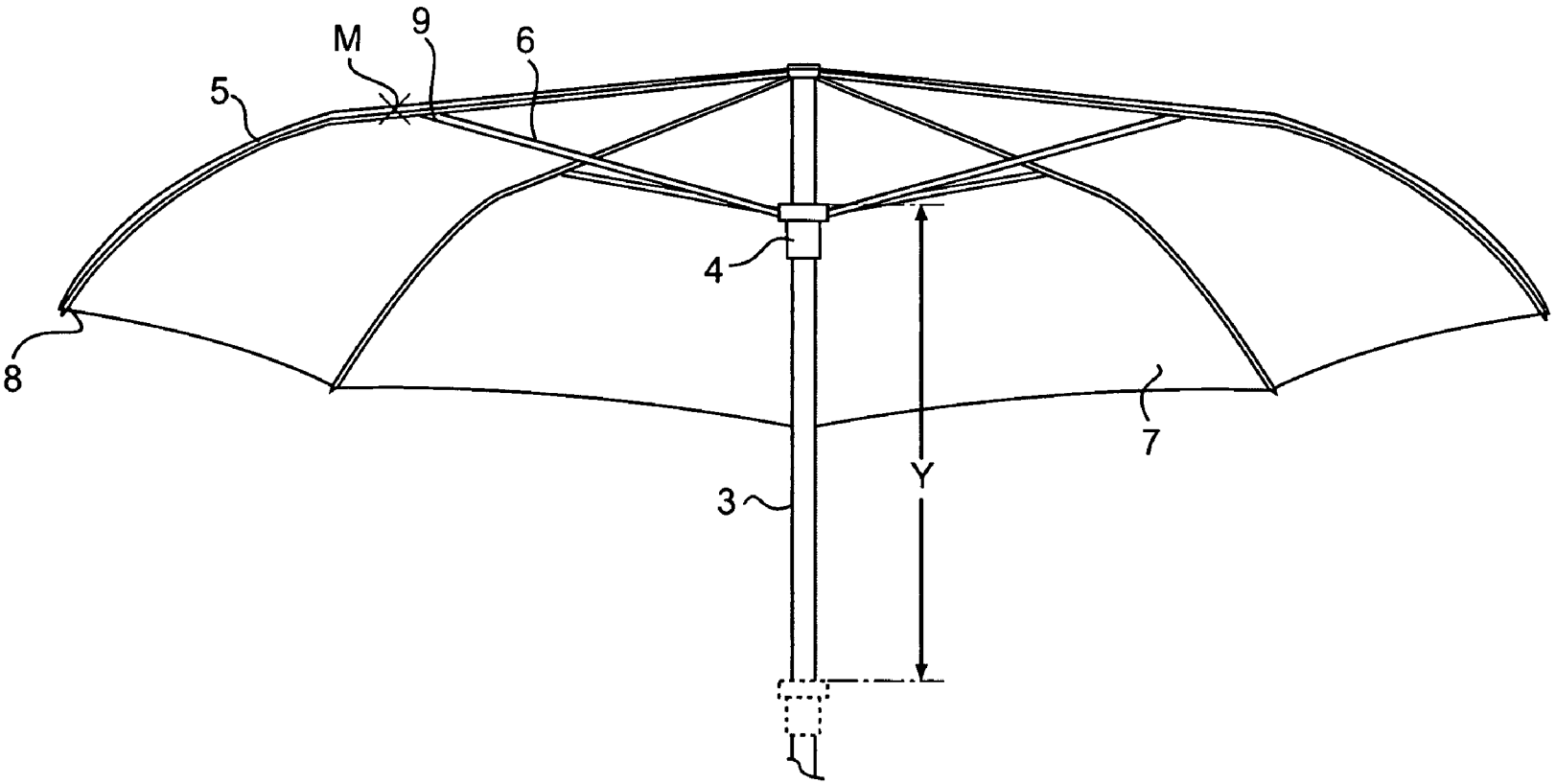
FIG. 1B PRIOR ART
FIGS. 1B, 1C and 1D are views partly in cross-section and partly in elevation of the prior art umbrella shown in FIG. 1A, with FIG. 1B showing the umbrella in the open state, FIG. 1C showing the umbrella in an intermediate state between the open state and a closed state, and FIG. 1D showing the umbrella in the nearly closed state.
Figure 1C:
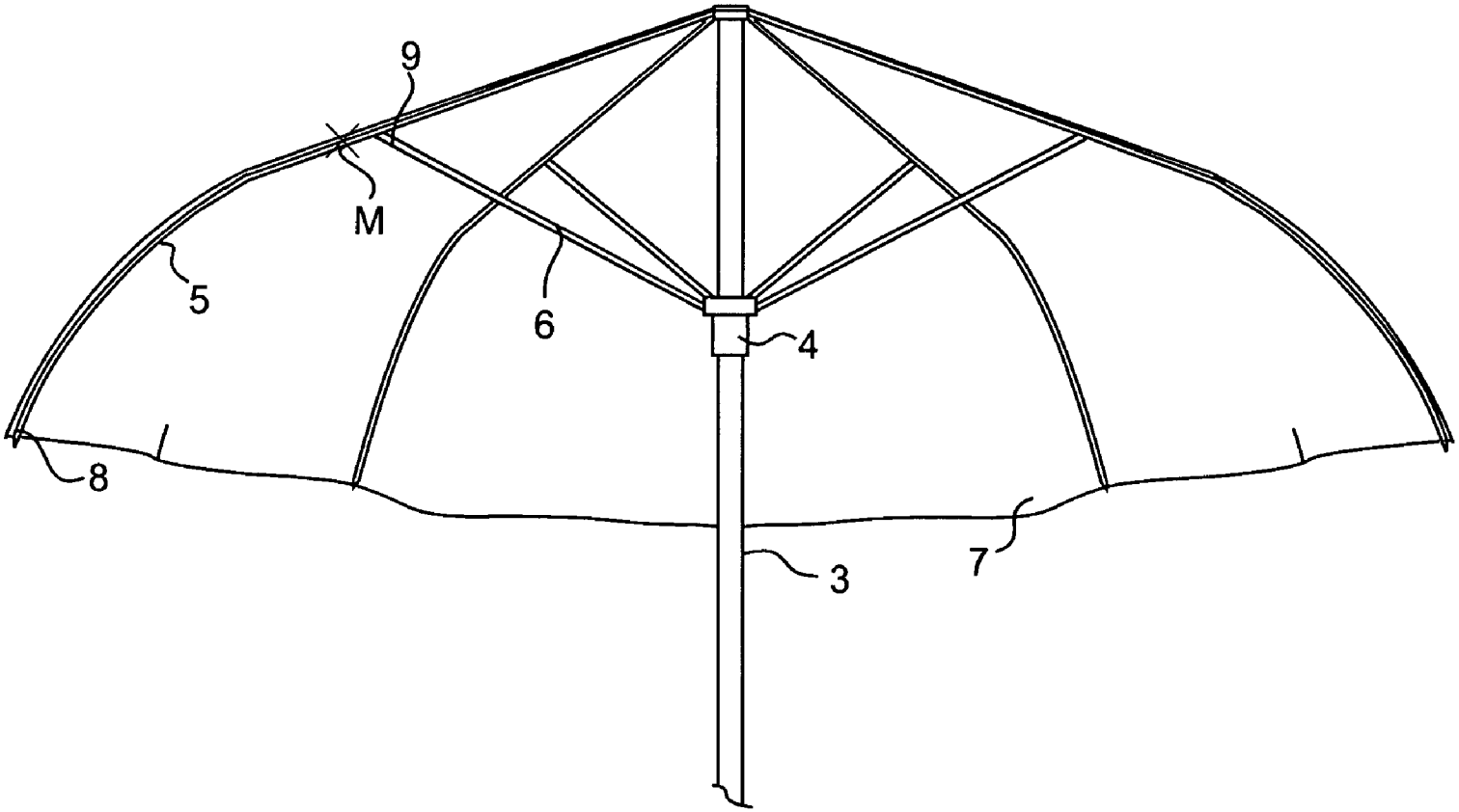
FIG. 1C PRIOR ART
Figure 1D:
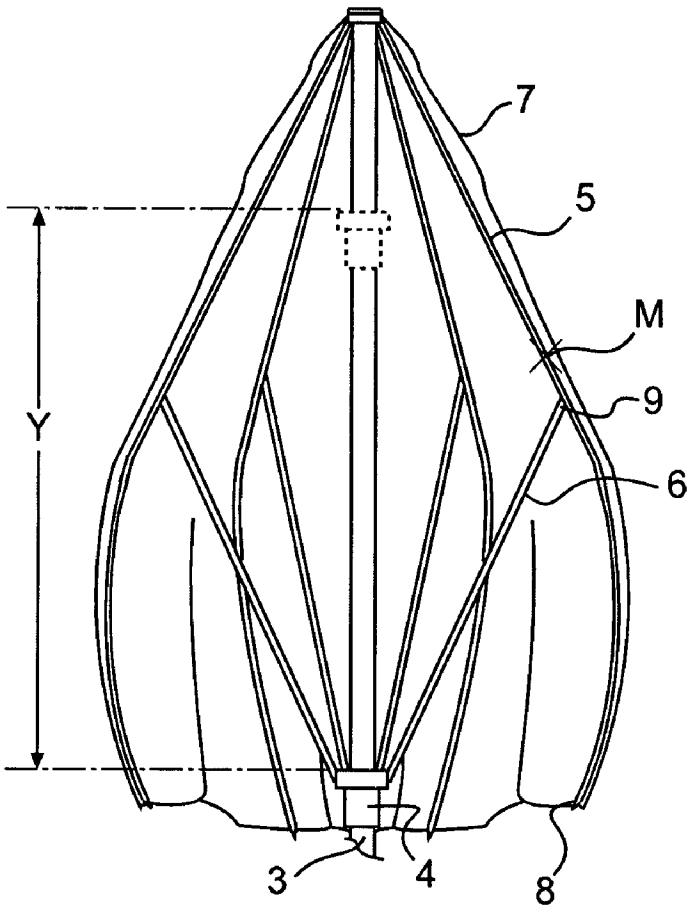
FIG. 1D PRIOR ART
Figure 2:
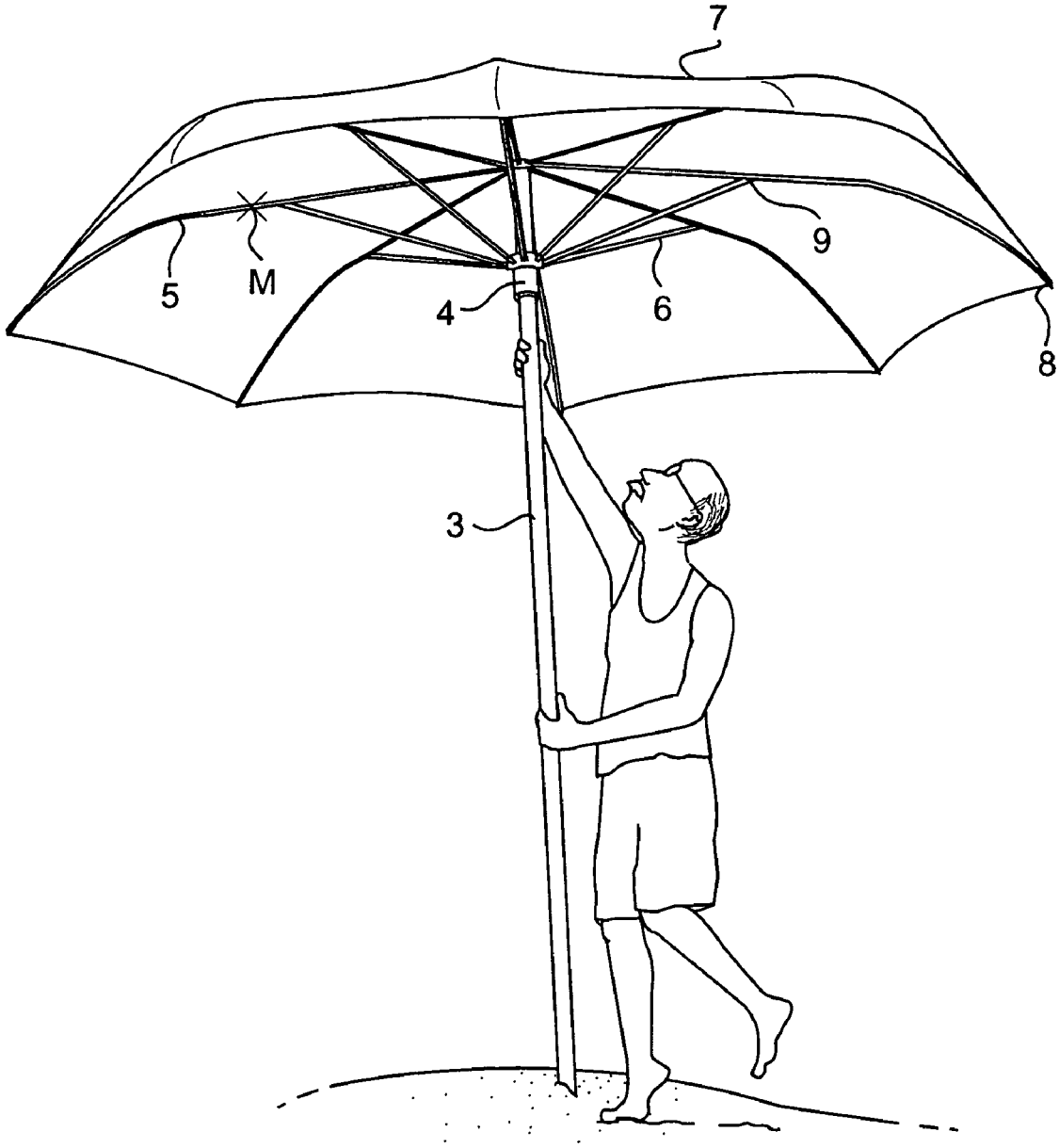
FIG. 2 PRIOR ART
FIG. 2 is a perspective view of a prior art large-scale umbrella in an open state, illustrating the problem of reach.
Figure 3:
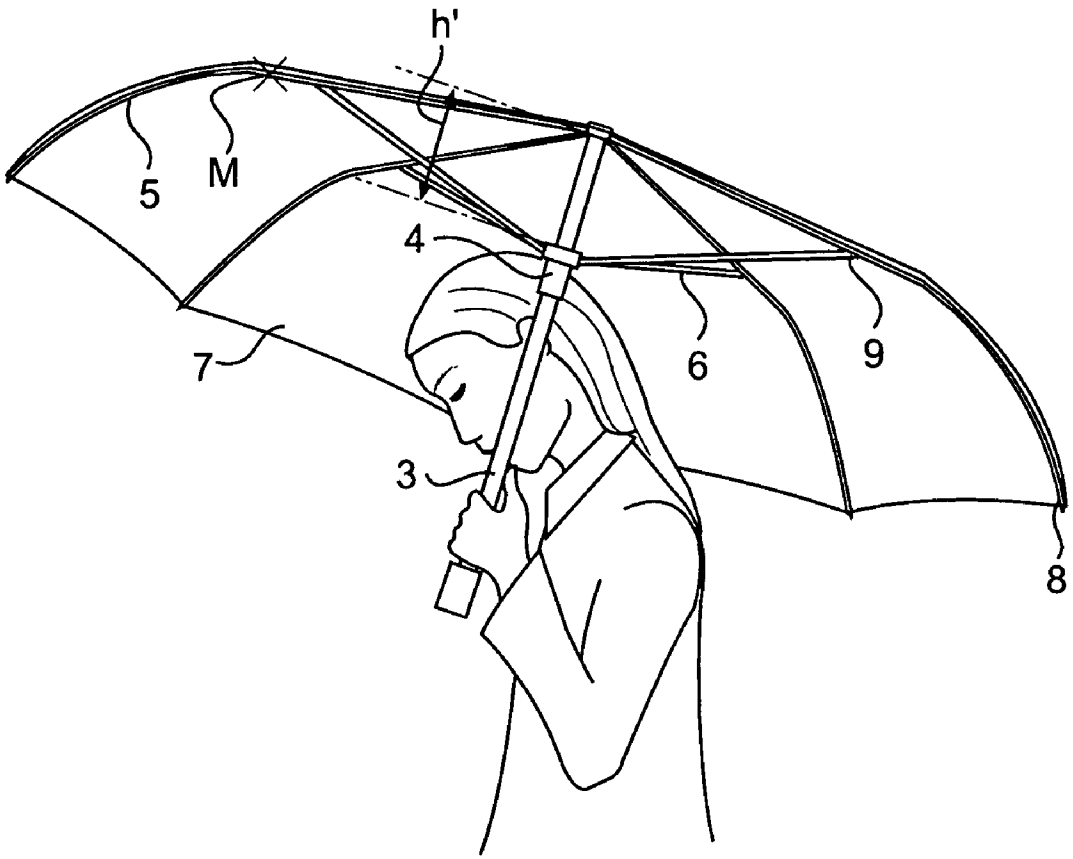
FIG. 3 PRIOR ART
FIG. 3 is a perspective view of a prior art umbrella in an open state, illustrating the problem of limited headroom.

The problem of limited headroom of the conventional umbrella is addressed by the present invention in the arrangement of the upper and lower ribs and staff assembly, as will be explained with reference to FIGS. 4 and 11, illustrating the umbrella of the present invention, and FIG. 3, illustrating the prior art. As noted, according to the present invention, canopy 107 may be disposed below lower ribs 106 (not shown), between lower ribs 106 and upper ribs 105 (FIG. 4), or above upper ribs 105 (not shown). If canopy 107 is disposed at lower ribs 106 (flush against lower ribs 106, either above or below them), as shown in FIG. 4, then no ribs protrude below the level of the canopy. In contrast, according to the conventional umbrella, lower ribs 6 do so protrude (FIG. 3), invading the space available for the user's head. If, according to the present invention, canopy 107 is disposed above and not flush against lower ribs 106, still lower ribs 106 protrude below the level of the canopy to a lesser extent than in the case of the conventional umbrella. This is seen, for example, in terms of the triangle formed by the upper and lower ribs and the staff assembly, discussed above. The distance h (FIG. 11) between the inner ends of the lower ribs and the inner ends of the upper ribs, i.e., the shortest leg of the triangle, is generally shorter than the corresponding distance h' (FIG. 3) in the conventional umbrella. A further factor contributing to improved headroom in the umbrella of the present invention is that, when the umbrella is in the open state lower ribs 106 angle slightly upward as they extend inwardly toward staff assembly 102, i.e., lower ribs 106 are directed away from the space provided for the user's head (FIG. 11). In contrast, in the conventional umbrella, lower ribs 6 angle somewhat downward, i.e., toward or even into the space provided for the user's head (FIG. 3). Still further, in some cases, headroom has been decreased in prior art umbrellas because the staff was shortened (see, e.g., FIG. 3) in order to prevent the problem of reach, discussed above. Since the present invention overcomes the problem of reach by provision of a near-full length outer staff member, headroom need not be decreased on this account.

In this regard, it is noted that the umbrella of the '187 patent also does not address the problem of limited headroom, in view of the fact that the '187 umbrella has connecting members and a sleeve similar to lower ribs 6 and ring 4, respectively, of the above-described conventional umbrella.

Figure 12B:
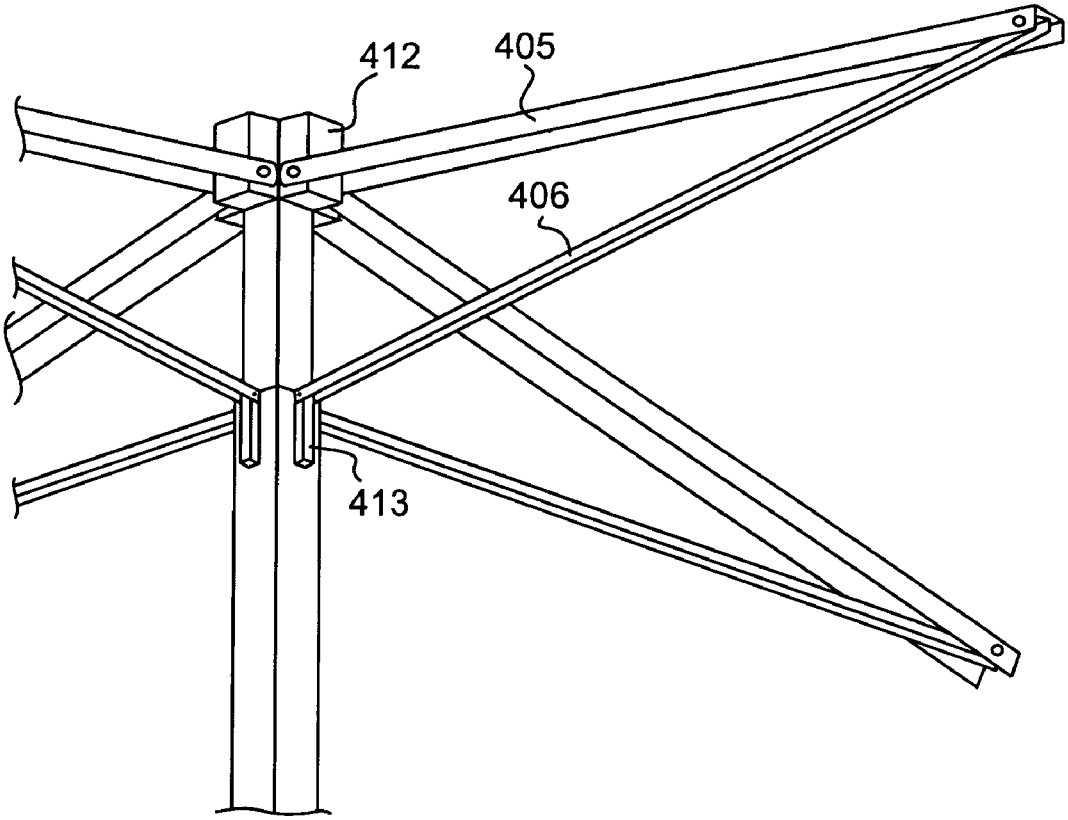

The problem of lack of compactness of the conventional umbrella is addressed by the present invention in a further embodiment thereof, which is illustrated in FIGS. 12A and 12B. As shown in the figures, upper ribs 405 and lower ribs 406 are formed as nesting members. Specifically, upper ribs 405 are formed as inverted channels, into which lower ribs 406 nestingly fit. Of course, the nesting structure could be reversed, i.e., lower ribs 406 could be formed as channels into which upper ribs 405 nestingly fit. When the upper and lower ribs are formed as nesting members, it will generally be simpler, although it is not required, to provide the canopy either below the lower ribs or above the upper ribs rather than between the lower and upper ribs. This nesting arrangement makes the umbrella more compact when in the closed state, without reducing the size of the umbrella when in the open state, that is to say, without reducing the scope of coverage provided by the canopy. In addition, the nesting arrangement renders the umbrella more stable when closed, as the nesting feature prevents the upper and lower ribs from moving relative to one another in a horizontal direction when retracted.

The problem in the prior art of lack of reparability, in particular, the fact that umbrella parts are generally not replaceable, is addressed by the present invention in the feature whereby the various connections between ribs, staff assembly, and canopy may be made releasable, as described above. In addition, as discussed, the improved durability and potential simplification of structure permitted by the present invention, while not directly affecting replaceablity of parts, yet may reduce the need for repairs altogether.

The issue of simplification of manufacture and consequent reduction in cost of production in the prior art is addressed by the present invention in the general simplicity of design of the invention, as compared to the prior art. The present invention improves the functionality of the umbrella, e.g., with respect to ease of operation, merely by redesign of basic components of the umbrella, rather than by adding additional components. Thus, the invention reduces the need to resort to auxiliary means, such as automatic operating means, to achieve this goal. Accordingly, the invention may be deemed to eliminate the need for such a complicating, extraneous component, thereby permitting manufacturers to revert to a simpler but improved product to satisfy the user's needs.

The aesthetic limitations in the prior art are addressed by the present invention in the easy replaceability of the canopy, and further by the particular embodiment in which the canopy comprises separate pieces to be freely selected and arranged by the user, both of which aspects of the present invention have been described above.

One of ordinary skill in the art will realize that modifications and variations, including but not limited to those discussed above, are possible within the spirit and scope of the present invention. The invention is intended to be limited in scope only by the accompanying claims, which should be accorded the broadest interpretation so as to encompass all such modifications, equivalent structures and functions.

What is claimed is:

1. An umbrella comprising:

a staff assembly including a first staff member having a proximal region and a distal region longitudinally opposite said proximal region, and a second staff member having a proximal region and a distal region longitudinally opposite said proximal region, said second staff member being mounted for relative axial movement with said first staff member;

a plurality of upper rib members each pivotally connected at its inner end to said proximal region of said first staff member;

a plurality of lower rib members each corresponding to one of said upper rib members, each said lower rib member being pivotally connected at its inner end to said proximal region of said second staff member and at its outer end to the outer end of the corresponding one of said upper rib members at the outer end of each of said upper rib members; and a canopy disposed (a) between said plurality of upper rib members and said plurality of lower rib members or (b) on a side of said plurality of lower rib members that is farthest from said plurality of upper rib members, wherein, by virtue of said pivotal connections, said upper and lower rib members may move between a deployed position in which said upper and lower rib members and said canopy extend generally radially outwardly from said staff assembly to open the umbrella, and a retracted position in which said upper and lower rib members and said canopy are collapsed inwardly toward said staff assembly to close the umbrella, and wherein said upper and lower rib members and said canopy are moved between the deployed and retracted positions to open and close the umbrella by relatively axially moving said first and second staff members.

2. An umbrella comprising:

a staff assembly including an inner staff member, and an outer staff member slidably mounted with said inner staff member;

a plurality of upper ribs pivotally connected, at respective inner ends thereof, to said inner staff member;

a plurality of lower ribs each corresponding to one of said upper ribs, each said lower rib being pivotally connected at its inner end to said outer staff member and at its outer end to an outer end of the corresponding one of said upper ribs at the outer end of each of said upper ribs; and a canopy mounted with at least one of said upper ribs and lower ribs, the canopy being disposed (a) between said plurality of upper ribs and said plurality of lower ribs or (b) on a side of said plurality of lower ribs that is farthest from said plurality of upper ribs, wherein said inner staff member, said outer staff member, said upper ribs, said lower ribs, and said canopy are operatively connected such that sliding said inner and outer staff members with respect to each other in a longitudinal direction of said inner and outer staff members shifts said upper and lower ribs and said canopy between a deployed position in which said upper and lower ribs and said canopy extend generally radially outwardly from said staff assembly to open the umbrella, and a retracted position in which said upper and lower ribs and said canopy are collapsed inwardly toward said staff assembly to close the umbrella.

3. The umbrella according to claim 2, wherein each of said upper ribs is longer than each of said lower ribs.

4. The umbrella according to claim 2, wherein no additional ribs are connected to said upper or lower ribs.

5. The umbrella according to claim 2, wherein said inner staff member is mounted within said outer staff member in telescoping relation, and wherein said outer staff member is longer than each of said lower ribs whereby, when the umbrella is in a closed state such that said upper and lower ribs are in the retracted position, said outer staff member extends longitudinally from a point at which said inner ends of said lower ribs are connected to said outer staff member beyond a point at which said outer ends of said upper and lower ribs abut said outer staff member, thereby providing a distal portion of said outer staff member, longitudinally opposite to a center of said canopy, said distal portion being capable of being grasped by a user's hand for holding, opening or closing the umbrella unimpeded by said upper and lower ribs.

6. The umbrella according to claim 2, wherein each of said upper and lower ribs is an unjointed member.

7. The umbrella according to claim 2, wherein each of said upper ribs is configured to receive at least partially one of said lower ribs in nesting relation as the umbrella is closed.

8. The umbrella according to claim 2, wherein each of said lower ribs is configured to receive at least partially one of said upper ribs in nesting relation as the umbrella is closed.

9. The umbrella according to claim 2, wherein peripheral portions of said canopy are connected to said outer ends of at least one of said upper and said lower ribs.

10. The umbrella according to claim 2, wherein at least some of said connections between said inner ends of said upper ribs and said inner staff member, between said inner ends of said lower ribs and said outer staff member, between said outer ends of said lower ribs and said outer ends of said upper ribs, and between said canopy and said upper or lower ribs are selectably releasable.

11. The umbrella according to claim 2, wherein said canopy comprises a plurality of canopy pieces and a fastener for removably fastening each of said canopy pieces to at least one other canopy piece.

12. The umbrella according to claim 2, further comprising mechanical means for relatively moving the inner and outer staff members between an open position and a closed position.

13. The umbrella according to claim 12, further comprising a handle, wherein said mechanical means is operable from said handle.

14. The umbrella according to claim 2, further comprising moving means for relatively moving the inner and outer staff member with respect to each other in a longitudinal direction.

15. An umbrella comprising:

a staff assembly including an inner staff member, and an outer staff member slidably mounted on said inner staff member;

a plurality of upper ribs each of which is pivotally connected at its inner end to said inner staff member;

a plurality of lower ribs each corresponding to one said upper rib, each said lower rib being pivotally connected at its inner ends to said outer staff member, and at its outer end to the outer ends of said corresponding one of said upper ribs at the outer end of each of said upper ribs; and a canopy connected to at least one of said plurality of upper ribs or said plurality of lower ribs, wherein said inner staff member, said outer staff member, said upper ribs, said lower ribs, and said canopy are operatively connected such that sliding said inner and outer staff members with respect to each other in their longitudinal direction shifts said upper and lower ribs and said canopy between a deployed position in which said upper and lower ribs and said canopy extend generally radially outwardly from said staff assembly to open the umbrella, and a retracted position in which said upper and lower ribs and said canopy are collapsed inwardly toward said staff assembly to close the umbrella, and wherein each of said upper ribs is formed as an inverted channel to receive one of said lower ribs in nesting relation as the umbrella is closed.

16. An umbrella comprising:

a staff assembly including an inner staff member, and an outer staff member slidably mounted on said inner staff member;

a plurality of upper ribs each of which is pivotally connected at its inner end to said inner staff member;

a plurality of lower ribs each corresponding to one said upper rib, each said lower rib being pivotally connected at its inner ends to said outer staff member, and at its outer end to the outer ends of said corresponding one of said upper ribs at the outer end of each of said upper ribs; and a canopy connected to at least one of said plurality of upper ribs or said plurality of lower ribs, wherein said inner staff member, said outer staff member, said upper ribs, said lower ribs, and said canopy are operatively connected such that sliding said inner and outer staff members with respect to each other in their longitudinal direction shifts said upper and lower ribs and said canopy between a deployed position in which said upper and lower ribs and said canopy extend generally radially outwardly from said staff assembly so as to open the umbrella, and a retracted position in which said upper and lower ribs and said canopy are collapsed inwardly toward said staff assembly so as to close the umbrella, and wherein each of said lower ribs is formed as a channel to receive one of said upper ribs in nesting relation as the umbrella is closed.

* * * * *